US008550831B2

(12) United States Patent
Nishijima

(10) Patent No.: US 8,550,831 B2
(45) Date of Patent: Oct. 8, 2013

(54) CONNECTOR HOUSING WITH AN OPENING FOR HOLDING ANOTHER CONNECTOR HOUSING FOR PROVIDING MOVEMENTS IN THREE MUTUALLY PERPENDICULAR DIRECTIONS

(75) Inventor: Yoshiharu Nishijima, Kahoku (JP)

(73) Assignee: Fujitsu Limited, Kawasaki (JP)

( * ) Notice: Subject to any disclaimer, the term of this patent is extended or adjusted under 35 U.S.C. 154(b) by 17 days.

(21) Appl. No.: 13/441,957

(22) Filed: Apr. 9, 2012

(65) Prior Publication Data

US 2012/0276781 A1 Nov. 1, 2012

(30) Foreign Application Priority Data

Apr. 28, 2011 (JP) ..... 2011-102044

(51) Int. Cl.
*H01R 13/64* (2006.01)

(52) U.S. Cl.
USPC ..... 439/248

(58) Field of Classification Search
USPC ..... 439/246–248, 640
See application file for complete search history.

(56) References Cited

U.S. PATENT DOCUMENTS

| | | | | |
|---|---|---|---|---|
| 6,196,856 | B1 * | 3/2001 | De Villeroche | 439/248 |
| 7,887,350 | B2 * | 2/2011 | Fukazawa et al. | 439/247 |
| 2006/0258199 | A1 * | 11/2006 | Umehara et al. | 439/247 |
| 2013/0017729 | A1 * | 1/2013 | Kimura et al. | 439/626 |

FOREIGN PATENT DOCUMENTS

JP 2005-129454 5/2005

* cited by examiner

*Primary Examiner* — Chandrika Prasad
(74) *Attorney, Agent, or Firm* — Fujitsu Patent Center

(57) ABSTRACT

A collective connectors housing includes a first housing having a connector insertion opening to receive one or more connectors and configured to hold the one or more connectors in the connector insertion opening so as to be movable in a first direction perpendicular to a connector insertion direction; and a second housing having a housing insertion opening to receive the first housing and configured to hold the first housing so as to be movable in a second direction perpendicular to both the connector insertion direction and the first direction.

15 Claims, 18 Drawing Sheets

CONNECTOR HOUSING WITH AN OPENING FOR HOLDING ANOTHER CONNECTOR HOUSING FOR PROVIDING MOVEMENTS IN THREE MUTUALLY PERPENDICULAR DIRECTIONS

CROSS REFERENCE TO RELATED APPLICATIONS

This application is based upon and claims the benefit of priority of the prior Japanese Patent Application No. 2011-102044 filed on Apr. 28, 2011, the entire contents of which are incorporated herein by references.

FIELD

The embodiments discussed herein relate to a collective connectors housing, a collective connectors set, and an electronic apparatus.

BACKGROUND

Along with large-scale systematization of computers, the number of pins used in a connector is increasing, while miniaturization and a high degree of accuracy of the connector are demanded, to achieve a large-capacity high-speed network connection. In a computer system, a huge amount of tasks and accurate work techniques are required to connect a number of intrasystem cables one by one. Especially when using high-accuracy multipin connectors, there is a risk of connector pins bending during manual insertion because the connector may be inserted at an angle.

Connectors are used in various portable or mobile devices such as digital cameras to transmit and receive data to and from other electronic devices or electrically charge the portable devices. To absorb connection errors having occurred between connectors in a portable device, a floating structure which allows connectors to move in a certain range is proposed. See, for example, Japanese Laid-Open Patent Publication No. 2005-129454A.

The proposed floating structure provides a gap and elasticity such that a connector is movable in all the directions within a plane perpendicular to the insertion direction of the connector. However, with this structure, rotation or skew with respect to the insertion axis is likely to occur when the connector is inserted into a counterpart fixed connector.

This floating structure is designed for use in a portable device and it is hardly applied as it is to an elaborate connector structure for server systems or computer systems. In a large-scale computer system, a great number of connectors are fixed in one direction. Free connectors are brought into connection with the fixed connectors. Each connector has in general a quadrangular cross-sectional shape. To connect a large number of connectors at a time, the setup error margin in spacing between adjacent free connectors becomes strict depending on the quantity of rotation or skew of each connector. The more the number of connectors to be connected at a time, the more strict the setup error is.

The above-described floating structure includes a movable board, a holder for holding the board, elastic members and some other components, and the installation area of the floating structure becomes greater than the outer shape of the connector. For this reason, the proposed floating structure cannot be applied to an array of fixed connectors arranged at spacing narrower than the installation area of the floating structure. This is a physical issue. In addition, the floating structure needs relay adaptors or flexible relay cables, and accordingly, transmission loss due to the relay components is of concern in a high-speed transmission system.

KNOWN PUBLICATION(S)

Japanese Laid-open Patent Publication No. 2005-129454

SUMMARY

According to one aspect of the present disclosure, a collective connectors housing includes a first housing having a connector insertion opening to receive one or more connectors and configured to hold said one or more connectors in the connector insertion opening so as to be movable in a first direction perpendicular to a connector insertion direction; and a second housing having a housing insertion opening to receive the first housing and configured to hold the first housing so as to be movable in a second direction perpendicular to the connector insertion direction and the first direction.

According to another aspect of the present disclosure, a collective connectors set includes a plurality of connectors; a first housing having one or more connector insertion openings for holding the connectors so as to be movable in a first direction perpendicular to a connector insertion direction; and a second housing having a housing insertion opening for holding the first housing so as to be movable in a second direction perpendicular to the first direction and the connector insertion direction.

The object and advantages of the invention will be realized and attained by means of the elements and combinations particularly pointed out in the claims.

It is to be understood that both the foregoing general description and the following detailed description are exemplary and explanatory and are not restrictive to the invention as claimed.

DESCRIPTION OF EMBODIMENTS

Preferred embodiments of the present invention will be explained with reference to accompanying drawings. Explanation is made below using an example in which connector connection is applied to intrasystem cables for network-connecting multiple computers.

In view of the conventional circumstances, it is demanded to provide a connector connection structure capable of collective connection of a set of movable connectors to counterpart connectors mounted on a printed board at a time, without using a relay component such as another printed board.

Figure 1:
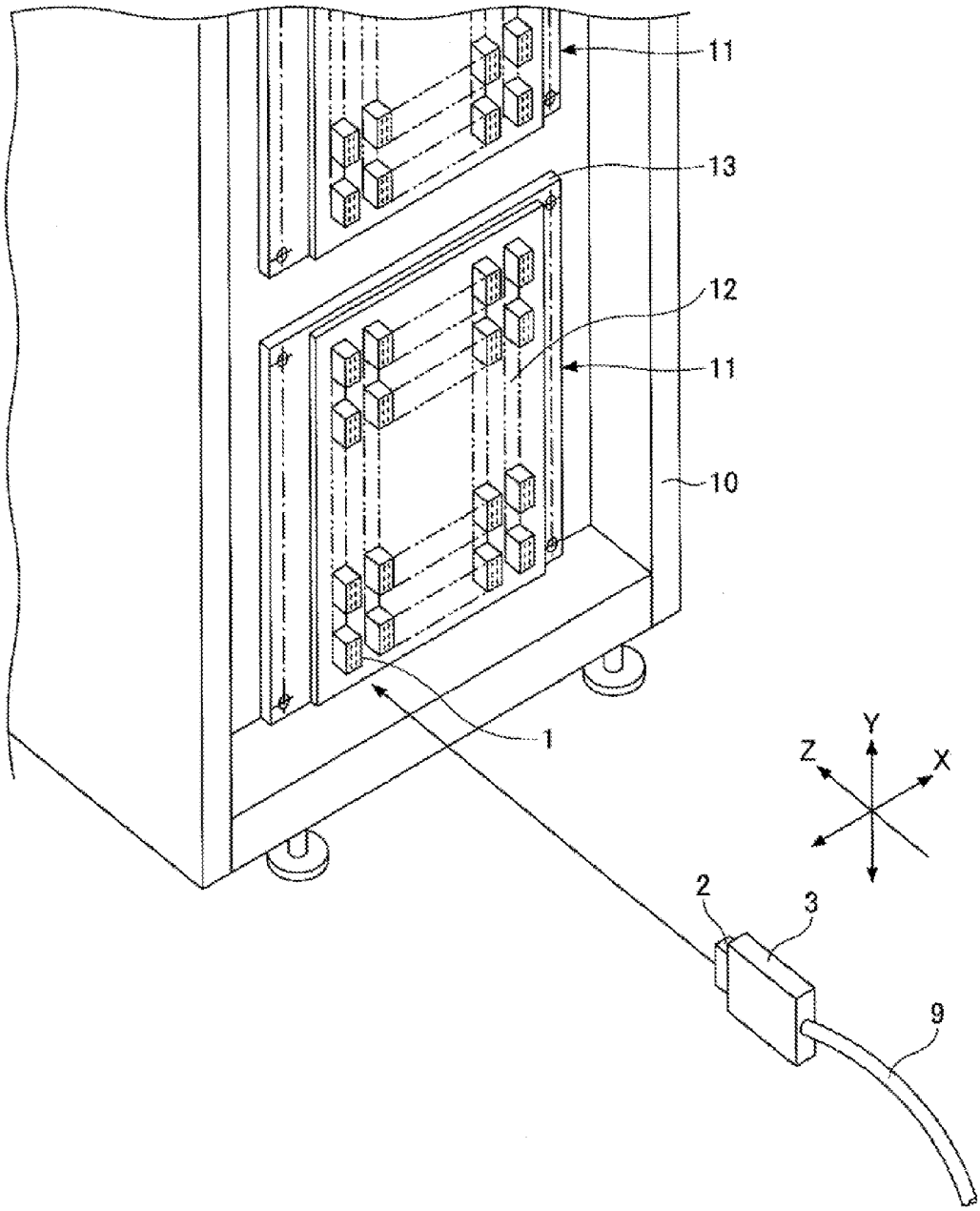
FIG. 1 is a schematic diagram illustrating a set of fixed connectors placed in an electronic apparatus and a part of a movable connector.

FIG. 1 is a schematic diagram illustrating a set of fixed connectors arranged in a computer 10 and a part of a movable connector 2. A number of fixed connectors 1 are mounted on a printed circuit board 12. The connector mounting board is a semifinished product in which function tests for the respective connectors 1 have not been completed. The semifinished product 11 is held on a reinforcing board 13.

The free connector 2 (which is referred to as an "movable connector 2") is to be electrically connected to a corresponding one of the fixed connectors 1 on the printed circuit board 12. Although only one movable connector 2 is depicted in FIG. 1, movable connectors 2 as many as the fixed connectors 1 are provided in an actual application.

The movable connector 2 is held in a connector housing 3 at the end of a connection cable 9 such that the leading end of the connector 2 projects from the connector housing 3. The connector housing 3 is a stand-alone connector housing for allowing independent connection of the connector 2. When connecting multiple computers 10 in a network, it is extremely inefficient to connect the movable connector 2 to the counterpart fixed connector 1 one by one. Accordingly, the embodiments provide a collective connectors housing that allows multiple connectors to be connected to and disconnected from counterpart connectors at a time with a single action. The embodiments also provide a collective connectors set using such a collective connectors housing, and an electronic apparatus making use of the collective connectors set.

In general, manufacturing variation exists among the movable connectors 2, and besides, positioning error arises when arranging movable connectors 2 at predetermined intervals. Accordingly, there is a demand for a structure to absorb or eliminate the manufacturing variation and positioning error during collective connection of multiple connectors.

If backlash allowance is provided all round the connector 2 to absorb the manufacturing variation and positioning error, a different amount of rotation or skew is generated around the insertion axis (along the Z-axis in FIG. 1) of each of the movable connectors 2, and therefore, the margin for position gap is set stricter. To overcome this issue, in the embodiments, motions in the X-axis direction and the Y-axis direction in an X-Y plane perpendicular to the Z-axis (in the connector insertion direction) are permitted independently from each other for the individual movable connector 2 within the range of the positioning tolerance. To be more precise, a collective connectors housing includes a first housing for holding movable connectors in one or more connector insertion openings so as to be movable in a first direction (e.g., the X-direction or Y-direction) and a second housing for holding the first housing in a housing insertion opening so as to be movable in a second direction (e.g., the Y-direction or X-direction) is provided.

Figure 2:
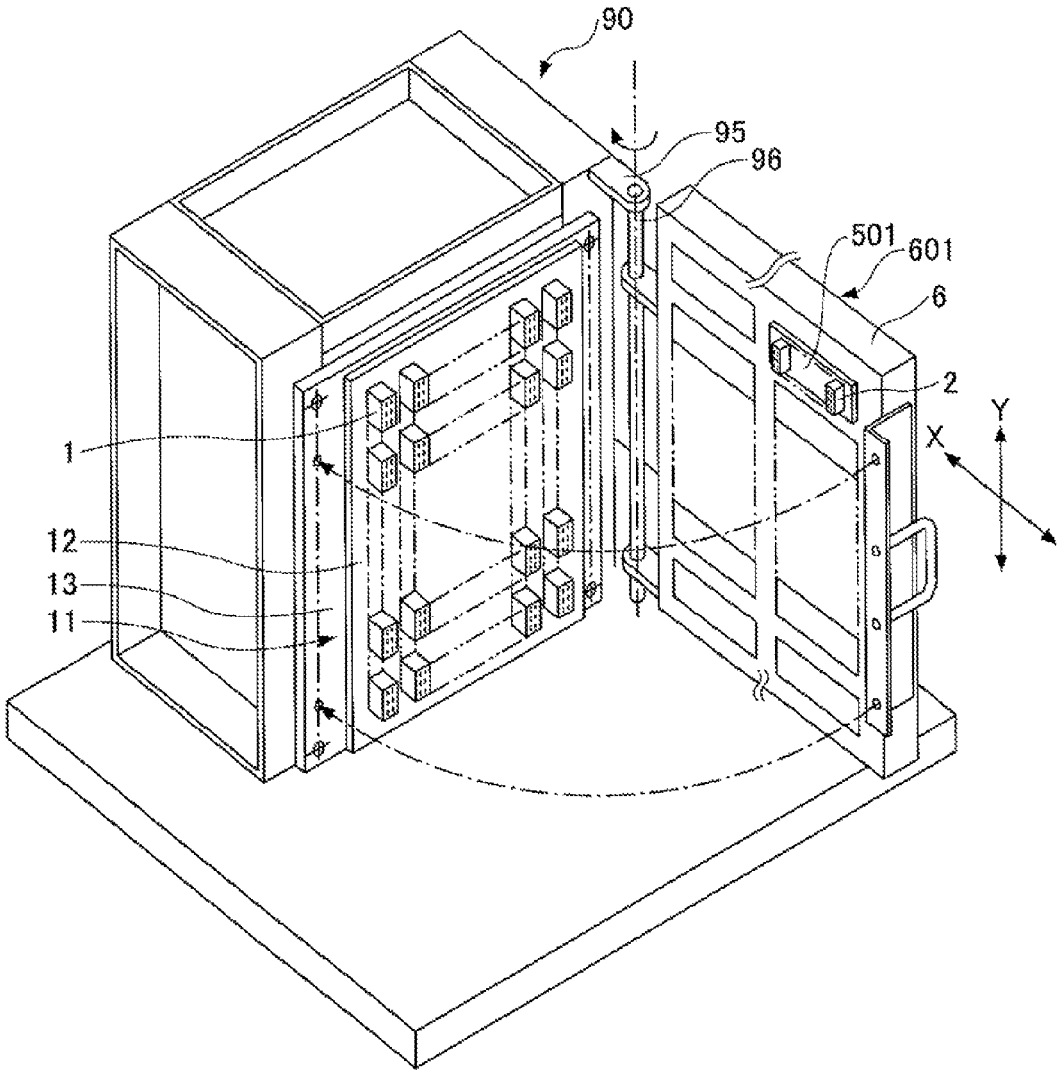
FIG. 2 is a schematic diagram illustrating a test apparatus according to an embodiment.

FIG. 2 is a schematic diagram illustrating a test apparatus 90 for performing a functional test on the semifinished product 11 of FIG. 1 which has been removed together with a reinforcing board 13 from the computer 10 and placed in the test apparatus 90. The test apparatus 90 is one of the examples of an electronic apparatus with a collective connector structure to which the present invention is applied. The test apparatus 90 has a collective block 601 in which intermediate blocks 501, each intermediate block 501 holding multiple movable connectors 2, are arranged in a predetermined layout. The collective block 601 serves as a collective connectors set 601 that allows a set of movable connectors 2 to be collectively connected to the counterpart fixed connectors 1 at once. The collective block (or the collective connectors set) 601 has a structure in which the movable connector 2 is held movable in the X-direction and the Y-direction independently from each other within the range of the tolerance.

In this example, the intermediate blocks 501 are arranged in columns extending in the Y-axis direction, and two columns are provided such that two intermediate blocks 501 are arranged in the X-axis direction. Of course, the invention is not limited to this example, and the collective block 601 includes at least one intermediate block 501. The intermediate block 501 holds multiple movable connectors 2 arranged in the X-axis direction in this figure. The movable connector 2 is arranged such that the long side extends parallel to the Y-axis direction. The collective block 601 holds the intermediate blocks 501 by means of a collective holder 6.

The collective block 601 is attached to the test apparatus 90 in a rotatable manner around a rotational axis such as a shaft 96. When placing the semifinished product 11 together with the reinforcing board 13 in the test apparatus 90, the collective block 601 is opened by rotating the entirety of the collective block 601 around the shaft 96. After the semifinished product 11 is placed in the test apparatus 90, the collective block 601 is shut by rotating the entirety of the collective block 601 in the direction of the curved arrows in FIG. 2. Then, the movable connectors 2 are plugged in the counterpart fixed connectors 1 collectively. Each of the movable connectors 2 is movable within a plane perpendicular to the insertion direction (Z-axis direction) in the X direction and the Y direction independently from each other, within a predetermined range of the tolerance (taking the manufacturing variation and the positioning error into account). Accordingly, variations and errors arising in the respective connectors can be absorbed. Some actual examples to realize the variation/error absorbing structure are described in more detail below.

In place of the collective block 601 of the single-swing type rotating around the shaft 96, a double-door type collective block set may be used. In this case, the collective block 601 in separated into two parts, each including a column of intermediate blocks 501, and each part is attached to either side of the test apparatus 90 so as to be rotatable around the associated one of the two rotary shafts (not shown). Alternatively, the collective block 601 may be separated into two or more parts in the Y-direction, each part extending in the X-direction.

[a] First Embodiment

Figure 3:
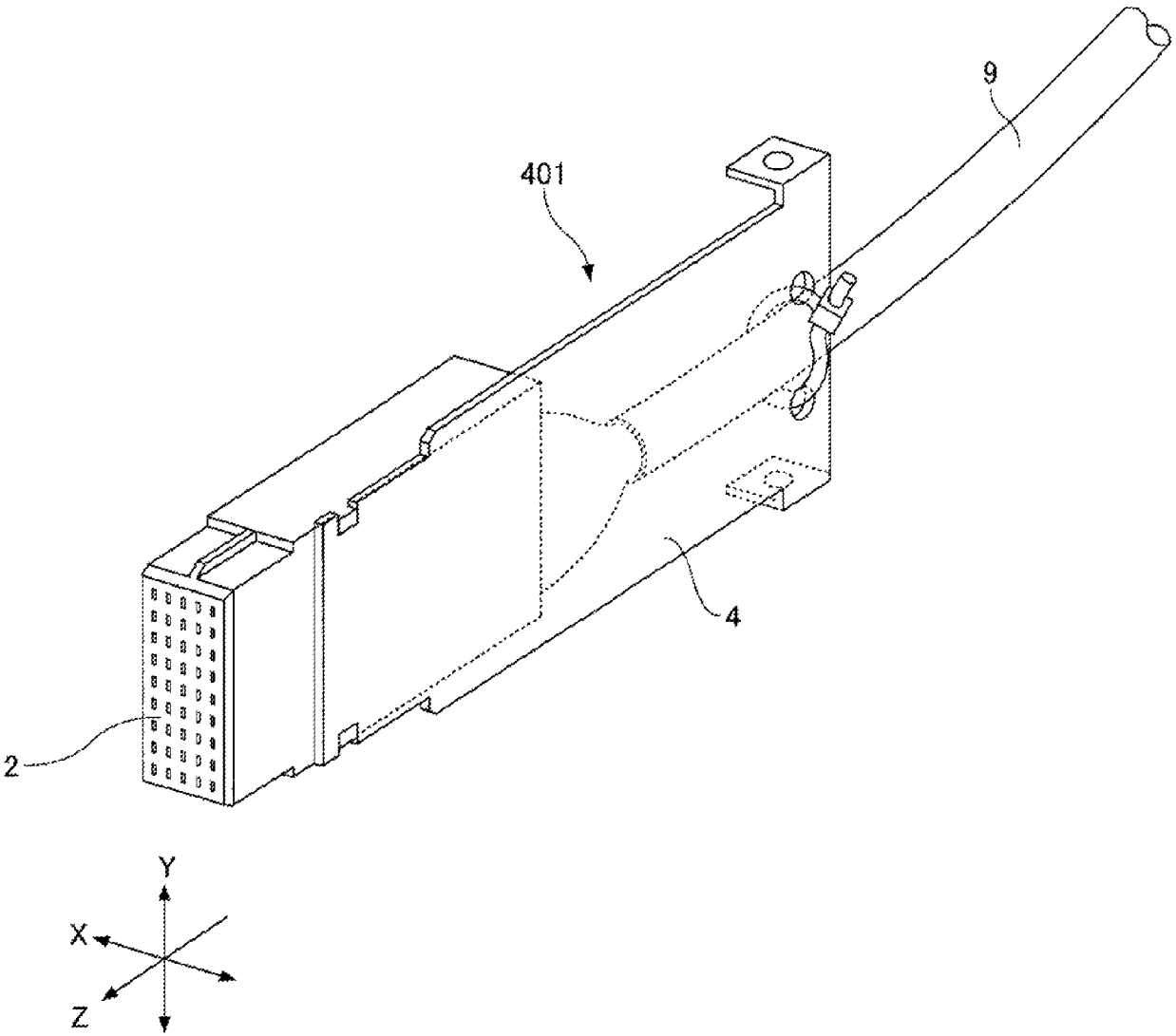
FIG. 3 is a schematic diagram illustrating a connector unit used in a collective connectors set according to the first embodiment.
Figure 4:
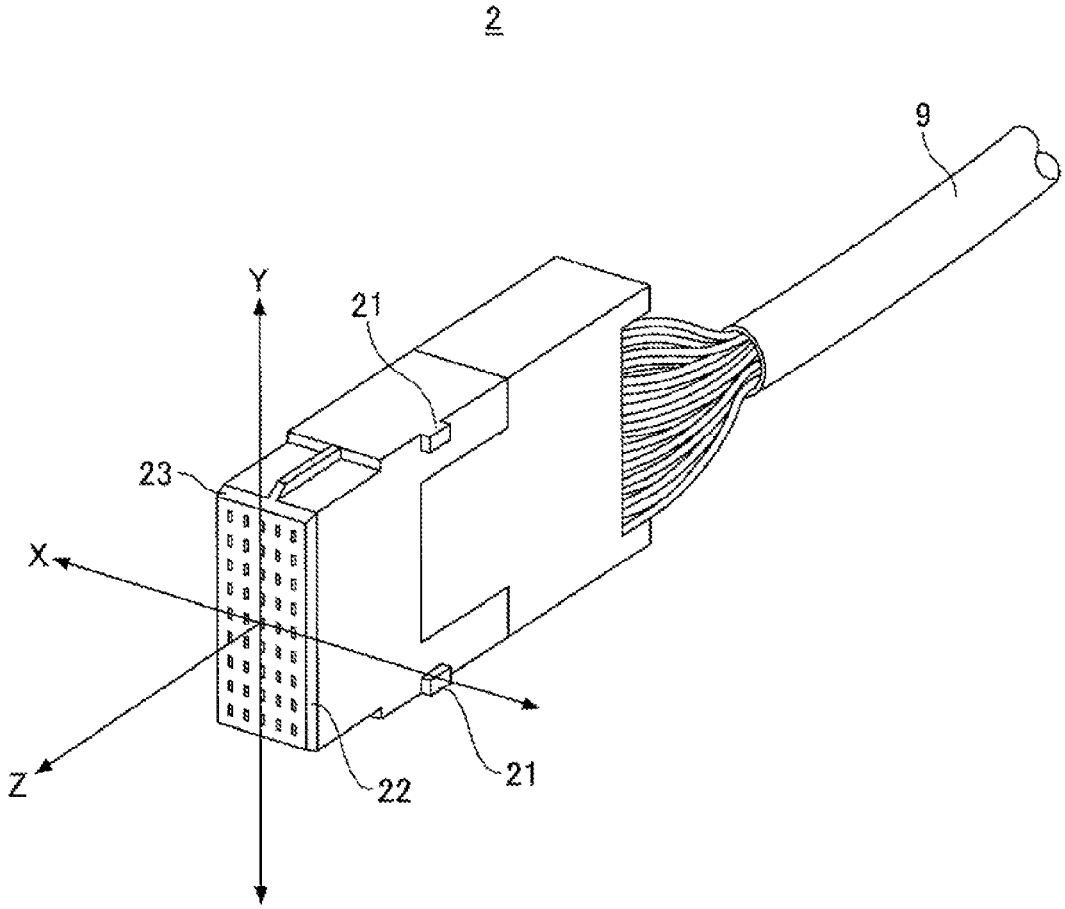
FIG. 4 is a schematic diagram illustrating a movable connector included in the connector unit of FIG. 3.
Figure 5:
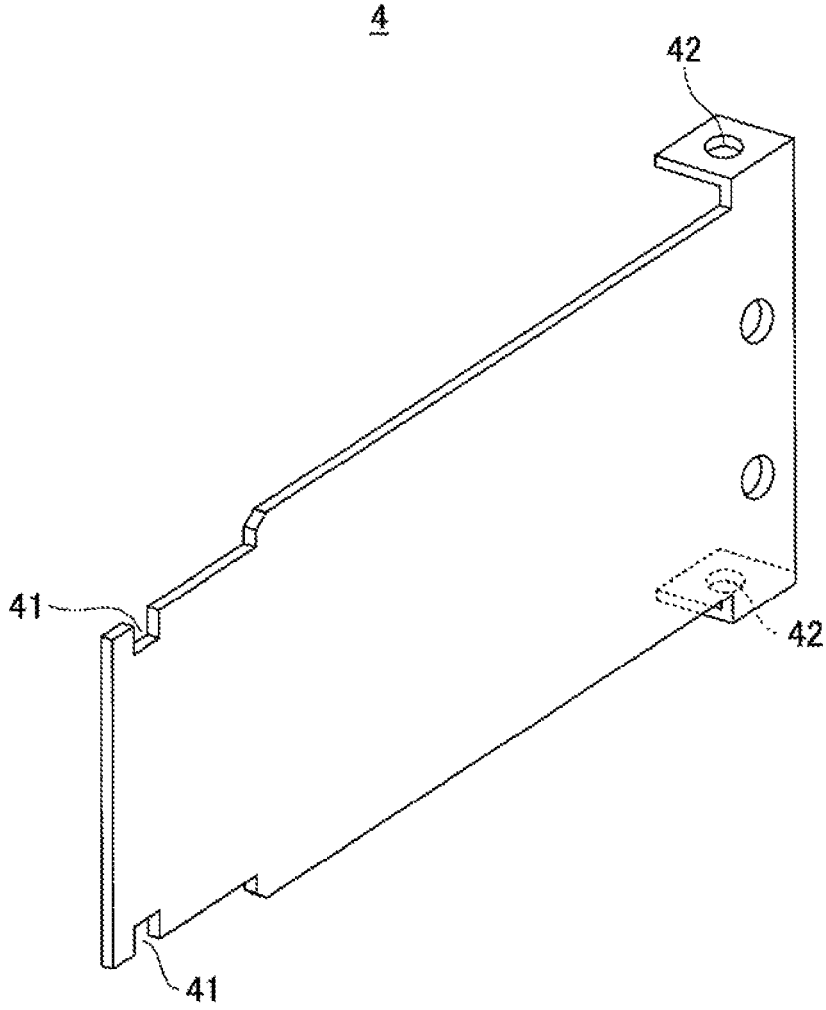
FIG. 5 is a schematic diagram illustrating a connector housing included in the connector unit of FIG. 3.

A collective connectors housing and a collective connectors set according to the first embodiment are explained with reference to FIG. 3 through FIG. 7. FIG. 3 is a schematic diagram illustrating a connector unit 401 in which a movable connector 2 connected to a cable 9 is held in a connector housing 4. FIG. 4 is a schematic diagram of the movable connector 2 used in FIG. 3, and FIG. 5 is a schematic diagram of the connector housing 4 used in FIG. 3. As illustrated in FIG. 3, the leading end of the movable connector 2 projects from the connector housing 4 of the connector unit 401 so as to be connectable to a fixed connector 1 (see FIG. 2). The base of the movable connector 2 and a part of the cable 9 are held by the connector housing 4.

Referring to FIG. 4, an acceptable position error of the movable connector 2 during connection with the counterpart fixed connector 1 is determined by a chamfer 22 and a chamber 23 of the leading face of the movable connector 2 extending in the Y-direction and the X-direction, respectively, and the shape of the fixed connector 1. It is assumed under the positional relationship of the X-axis, the Y-axis, and the Z-axis illustrated in FIG. 4 that the acceptable position errors of the movable connector 2 in the X-direction and the Y-direction are ±(ULx) and ±(ULy), respectively, during connector connection. The movable connector 2 has one or more projections 21 on the side face to be engaged in cutouts 41 of the connector housing 4 illustrated in FIG. 5.

In FIG. 5, the connector housing 4 has cutouts 41 near the leading end thereof to receive the projections 21 of the movable connector 2, and holes 42 at the trailing end (on the side of the cable 9) in the insertion direction. The connector housing 4 and the movable connector 2 are assembled into one unit as illustrated in FIG. 3 by bonding, caulking or screws (not shown) to form the connector unit 401.

Figure 6:
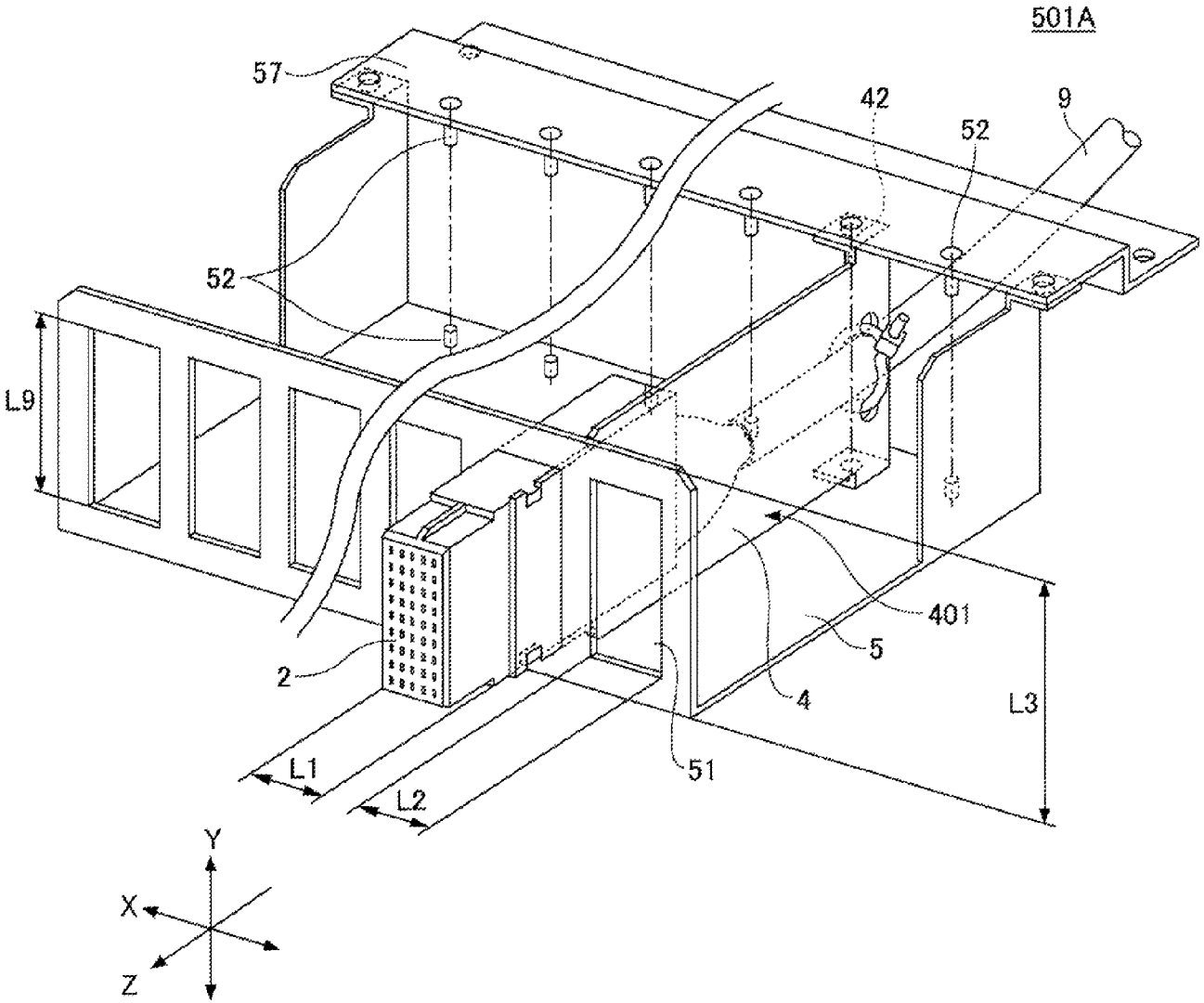
FIG. 6 is a schematic diagram illustrating an intermediate block used in the collective connectors set according to the first embodiment.

FIG. 6 is a schematic diagram of an intermediate block 501A in which the connector unit 401 of FIG. 3 is held by an intermediate holder 5. The intermediate holder 5 has rectangular openings (connector insertion openings) 51. The rectangular openings 51 are arranged in the X direction perpendicular to the insertion direction (Z-direction) of the connector unit 401. The front side of the connector unit 401 is received into the rectangular openings 51. The connector unit 401 receives pins 52 at the holes 42 formed in the trailing end of the connector housing 4. The pins 52 are provided to pin together the intermediate holder 5 and a roof 57. The constraint condition of the hole 42 of the connector housing 4 and the pin 52 is stopping the motion of the connector unit 401 in the Z-direction, while not preventing pivoting or swinging in the X-direction. If the connector housing 4 is made of an elastic thin plate and deformable by itself in the X-direction, the connector housing 4 may be screwed in place, instead of using the pin 52 and the hole 42.

Assuming that the size in X-direction of the connector unit 401 is L1, that the size in X-direction of the rectangular opening 51 of the intermediate holder 5 is L2, and that the X-direction positioning tolerance of the connector 2 is ±(ULx), then the relationship of mathematical formula (1) stands.

$$(L2-L1)/2<(ULx) \quad (1)$$

The movable connector 2 is movable in the X-direction within the range of ±(ULx) even if it is assembled into the intermediate holder 5.

In this configuration, the size L9 in Y-direction of the rectangular opening 51 provides a slight gap with the connector unit 401 so as not to prevent the free motion of the connector unit 401 in the X direction.

Although only a single connector unit 401 is depicted in FIG. 5, which unit is assembled in the intermediate unit 501A, for the convenience of illustration, multiple connector units 401 are inserted in the rectangular holes 51 to form the intermediate block 501A. In the first embodiment, the intermediate holder 5 of the intermediate block 501A serves as the first housing of the collective connectors housing capable of collective connection and disconnection of the movable connectors 2 with respect to the fixed connectors 1. The first housing (i.e., the intermediate holder) 5 holds the movable connector 2 in the rectangular opening (i.e., a connector insertion opening) 51 such that the movable connector 2 is movable in the first direction (for example, in the X-direction in the first embodiment) perpendicular to the connector insertion direction (Z-direction).

Figure 7:
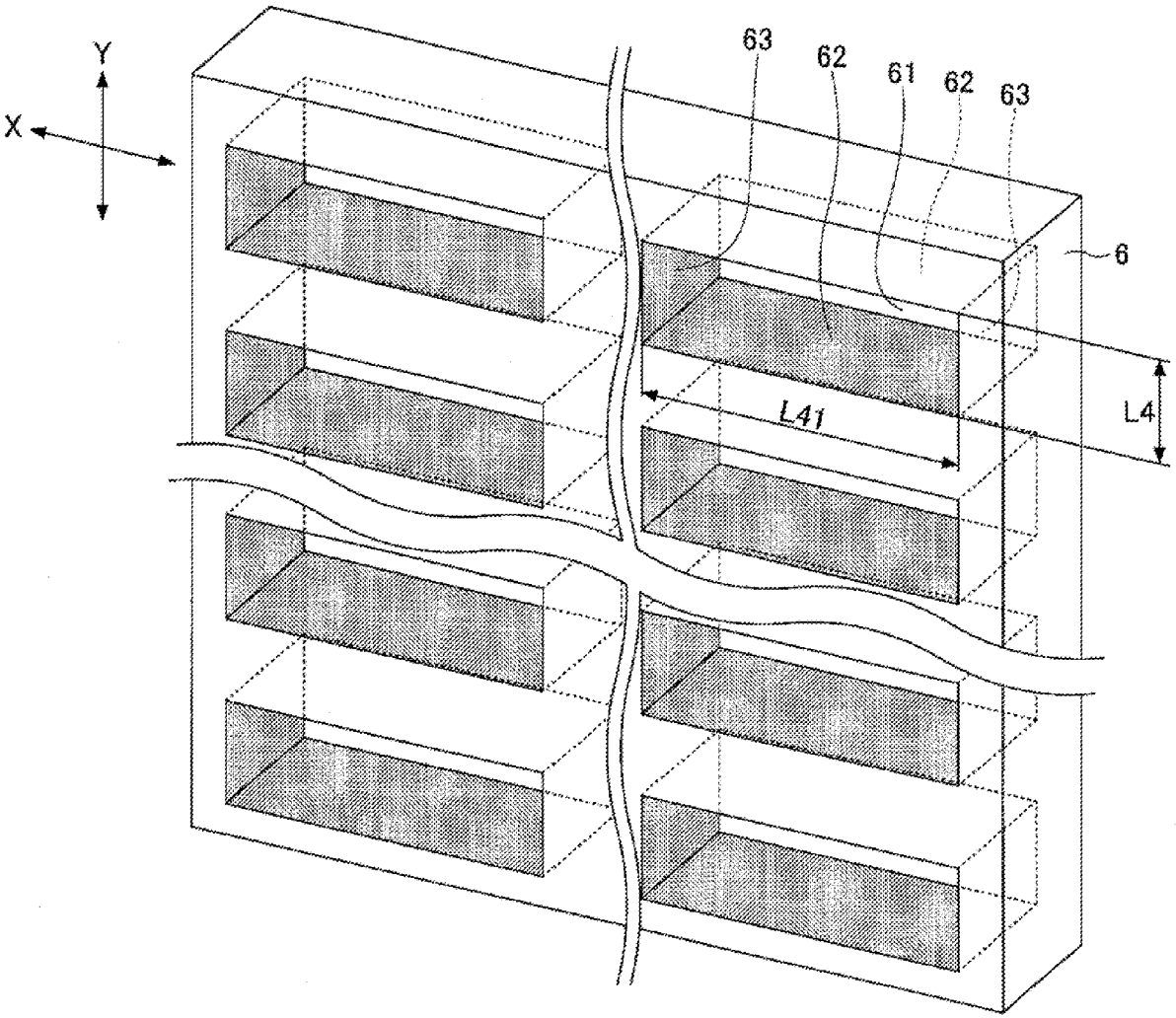
FIG. 7 is a schematic diagram illustrating a collective holder used in a collective connectors housing according to an embodiment.

FIG. 7 illustrates a collective holder 6 for holding intermediate blocks 501A to form the collective block 601 (see FIG. 2). The collective holder 6 has rectangular holes (i.e., housing insertion openings) 61 in which the intermediate blocks 501A of FIG. 6 are inserted.

If the sizes in the Y-direction and X-direction of the rectangular opening 61 of collective holder 6 are L4 and L41, respectively, then the relationship between L4 and the Y-direction size L3 of the intermediate block 501A is expressed by mathematical formula (2).

$$(L4-L3)/2<(ULy) \quad (2)$$

The movable connectors 2 held in the intermediate block 501A are movable in the Y-direction within the tolerance ±(ULy). The motion in the Y-direction is independent of the X-direction motion of each movable connector 2 allowed in the intermediate block 501A.

The X-direction size L41 of the rectangular opening 61 provides a slight gap between the intermediate block 501A so as not to prevent the motion of the intermediate block 501A in the connector insertion direction (i.e., the Z-direction). However, there is no backlash allowance that allows the intermediate block 501A to move in the X-direction. The collective holder 6 illustrated in FIG. 7 has guides 63 and guides 62. The guides 63 allow smooth insertion of the intermediate block 501A in the connector insertion direction (Z-direction), while restricting the motion of the intermediate block 501A in the X-direction. The guides 62 control the motion of the intermediate block 501A in the Y-direction within the range of size L4.

The collective holder 6 serves as the second housing of the collective connectors housing. The second housing holds the movable connectors 2 so as to be movable in the second direction (for example, in the Y-direction) perpendicular to both the connector insertion direction (Z-direction in this example) and the first direction (X-direction).

To attach the collective block 601 with the intermediate blocks 501A assembled therein to the test apparatus 90 of FIG. 2, the positional relationship between the collective block 601 and the array of the fixed connectors 1 is adjusted in advance such that the center axis of each fixed connector 1 and the insertion axis of the corresponding movable connector 2 are coincident with each other.

After the functional test using the test apparatus 90 (FIG. 2) is finished, the collective block 601 is opened to disconnect all the movable connectors 2 at once from the counterpart fixed connectors 1. Then, the printed circuit board 12 on which the fixed connectors 1 are mounted is removed together with the reinforcing board 13 from the test apparatus 90, and set in a predetermined position in the computer 10 of FIG. 1. The collective block 601 which serves as a set of collective connectors can also be used to connect multiple computers 10 to systemize a computer network. In this case, a computer is connected to another computer at once using connector cables to which the collective connectors set realized as the collective block 601 is applied.

In the first embodiment, the intermediate holder 5 serves as the first housing to hold the movable connector 2 movable in the X-direction. The collective holder 6 serves as the second housing to allow the movable connector 2 to move in the Y-direction independently from the motion in the X-direction. The first housing and the second housing form a collective connectors housing.

By installing movable connectors 2 in the collective connectors housing, a collective connectors set 601 (FIG. 2) capable of collective connection and disconnection is realized. Freedom in the X-direction is given to each of the movable connectors 2, while freedom in the Y-direction is given to each intermediate block 501A (on the intermediate block basis). Because the movable connector 2 is held so as to be movable in the X-direction and the Y-direction independently from each other, manufacturing variation and positioning error are appropriately eliminated, while keeping the margin or tolerance less strict.

[b] Second Embodiment

Figure 8:
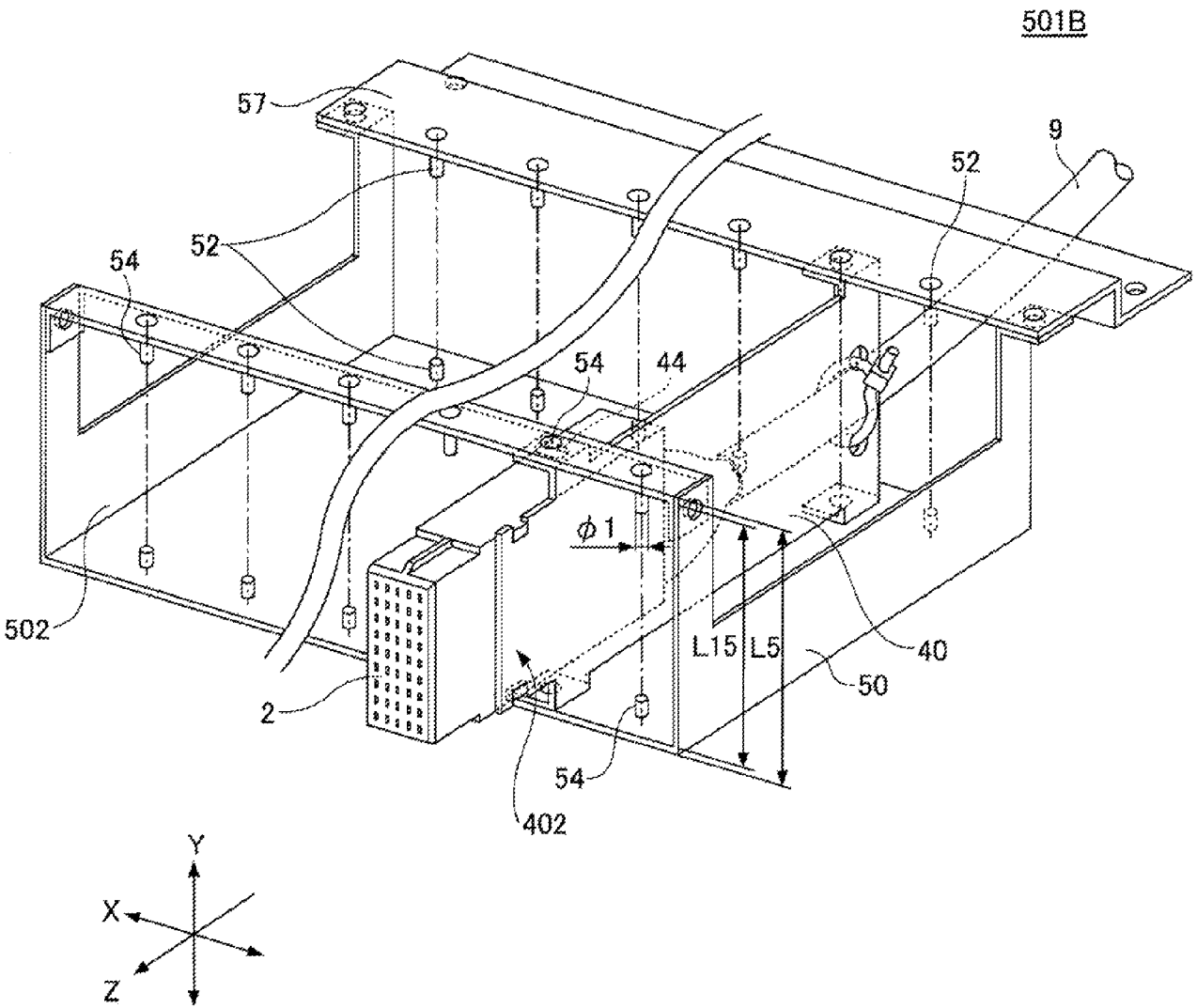
FIG. 8 is a schematic diagram illustrating a connector unit and a part of an intermediate block according to the second embodiment.
Figure 9:
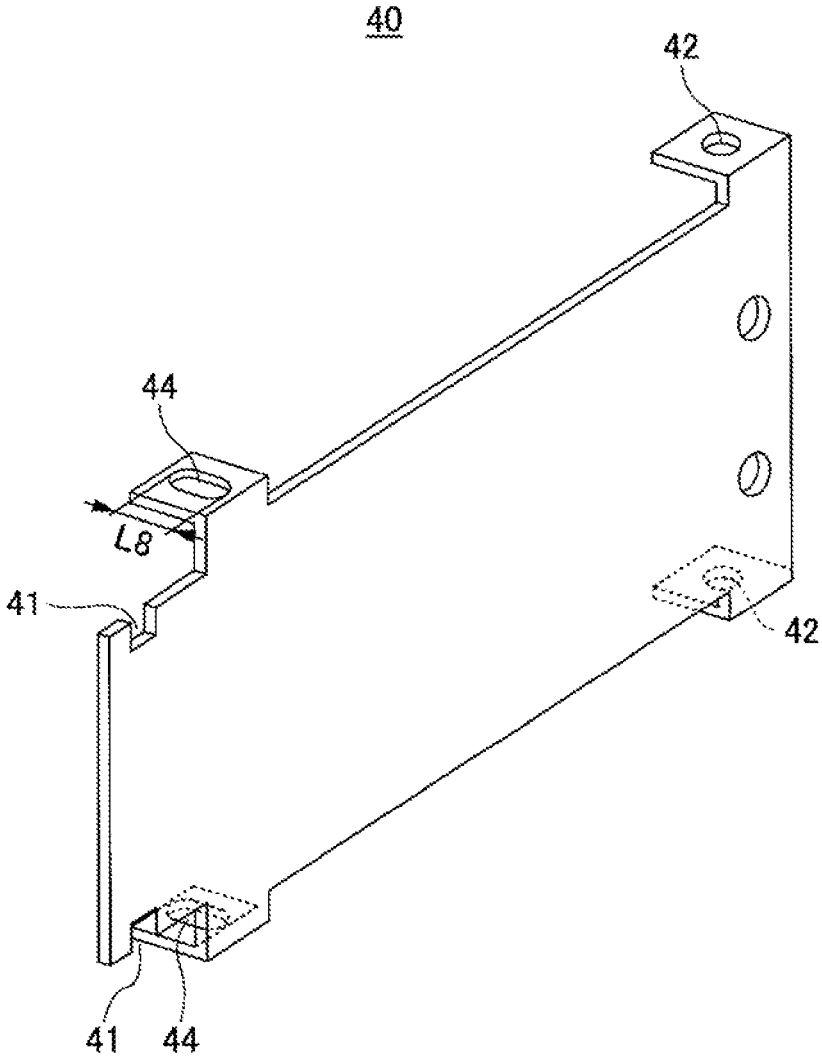
FIG. 9 is a connector housing according to the second embodiment.

FIG. 8 and FIG. 9 are diagrams for explaining a collective connectors housing and a collective connectors set according to the second embodiment. FIG. 8 schematically illustrates an intermediate block 501B of the second embodiment, and FIG. 9 schematically illustrates a connector housing 40 used in the intermediate block 501B of FIG. 8. In the second embodiment, each of the movable connectors 2 is held so as to be movable in the X-direction within a predetermined range as in the first embodiment, but with a different structure.

In FIG. 8, the intermediate block 501B includes an intermediate holder 50 and multiple connector units 402 held in the intermediate holder 50. Each of the connector units 402 includes one of the movable connectors 2 and one of the connector housings 40 for holding the movable connector 2. The intermediate holder 50 has an opening (a connector insertion opening) 502 to allow the connector units 402 to pass through. The intermediate holder 50 also has first pins 52 provided near the trailing end (or the cable part) of the connector unit 402 and second pins 54 provided near the leading end of the connector unit 402 in the insertion direction (Z-direction). The first pins 52 and the second pints 54 are arranged in the X direction at a pitch corresponding to the array pitch of the fixed connectors 1 (see FIG. 1).

In FIG. 9, the connector housing 40 has first holes 42 for receiving the first pins 52 of the intermediate holder 50 and second holes 44 for receiving the second pins 54 of the intermediate holder 50. The second holes 44 are elongated holes. When assembling the movable connector 2 in the connector housing 40 to form the connector unit 402, the projections 21 (FIG. 4) of the movable connector 2 are fit into the cutouts 41 of the connector housing 40. The movable connector 2 and the connector housing 40 are combined into a single unit by adhesive, caulking, screws or any suitable means.

Returning to FIG. 8, multiple of the connector units 402 are inserted in the opening 502 of the intermediate holder 50 to assemble the intermediate block 501B. The elongated hole 44 of the connector unit 402 has a long axis extending in the X-direction. When the connector unit 402 is inserted in the opening 502 of the intermediate holder 50, it receives the second pins 54 in the elongated holes 44. The second pin 54 is movable in the X-direction in the associated elongated hole 44. On the other hand, the constraint condition of the first pin 52 of the intermediate holder 50 and the hole 44 of the connector unit 402 is stopping the motion of the connector unit 402 in the Z-direction, while not preventing pivoting or swinging in the X-direction, as in the first embodiment.

The relationship between the X-direction size L8 of the elongated hole 44 of the connector housing 40 and the diameter Φ1 of the second pin 54 of the intermediate holder 50 is expressed as mathematical formula (3).

$$(L8-\Phi 1)/2<(ULx). \tag{3}$$

Each of the movable connectors 2 is movable in the X-direction within the X-direction positioning tolerance.

Intermediate blocks 501B are assembled into the collective holder 6 of FIG. 7 to form a collective connectors set 601 (see FIG. 2). The relationship between the Y-direction size L5 of the movable connector 2 and the Y-direction size L4 of the rectangular opening 61 of the collective holder 6 satisfies mathematical formula (4).

$$(L4-L5)/2<(ULy) \tag{4}$$

Accordingly, each of the movable connectors 2 is movable in the Y-direction within the Y-direction positioning tolerance.

In the second embodiment, the X-direction freedom is given independently to each of the movable connectors 2 and the Y-direction freedom is given on the intermediate block basis to each of the intermediate blocks 501B, as in the first embodiment. The intermediate holder 50 having second pins 54 to be received in the elongated holes 44 of the connector housing 40 is the first housing that holds the movable connectors 2 so as to be movable in the X-direction. The collective holder having one or more rectangular openings 61 is the second housing that holds the movable connectors 2 so as to be movable in the Y-direction. The first housing and the second housing form a collective connectors housing.

By assembling a number of movable connectors 2 into the collective connectors housing, a collective connectors set 601 (FIG. 2) is realized. By coupling the collective connectors set to desired equipment, an electronic apparatus with an efficient connector structure is provided.

[c] Third Embodiment

Figure 10:
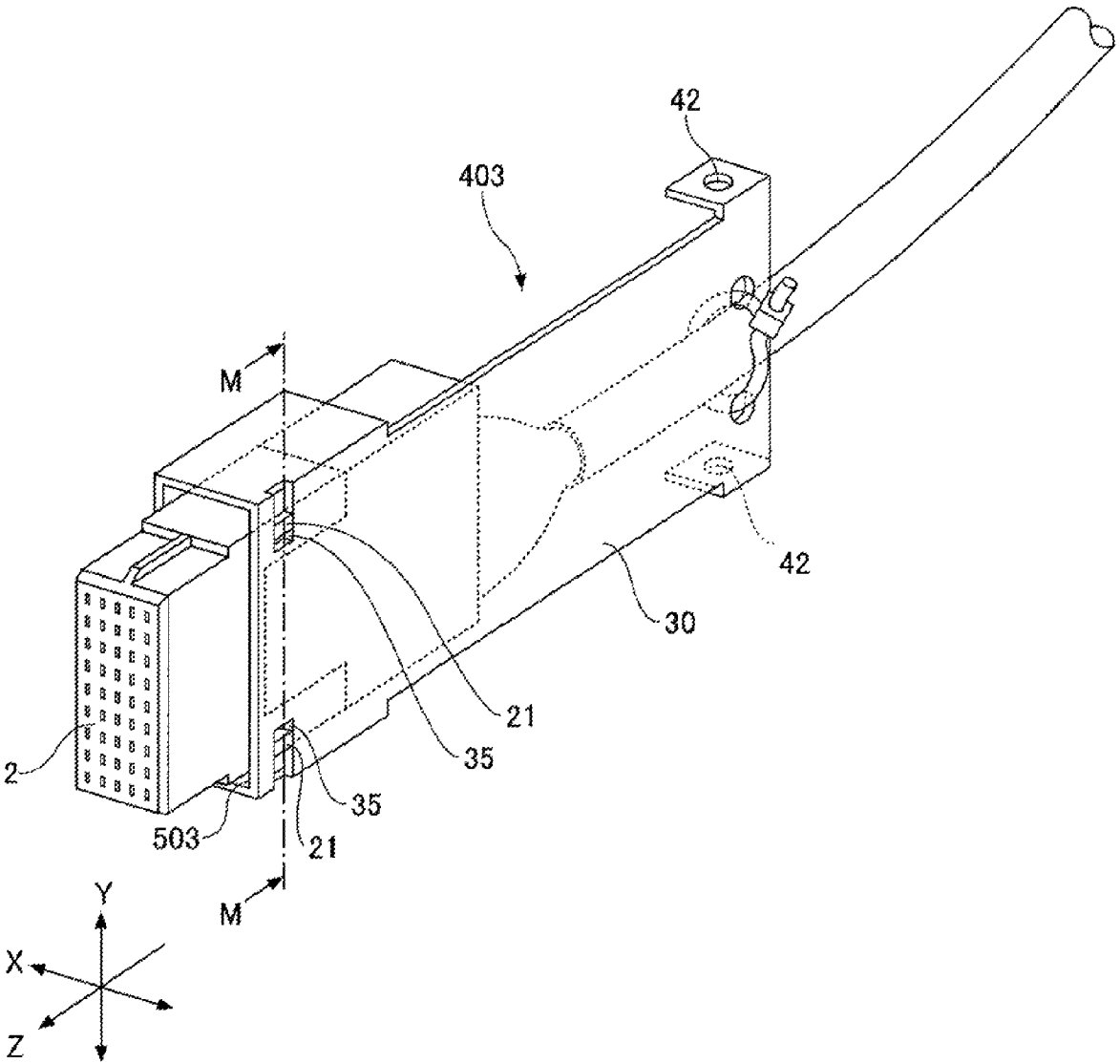
FIG. 10 is a schematic diagram illustrating a connector unit according to the third embodiment.
Figure 11:
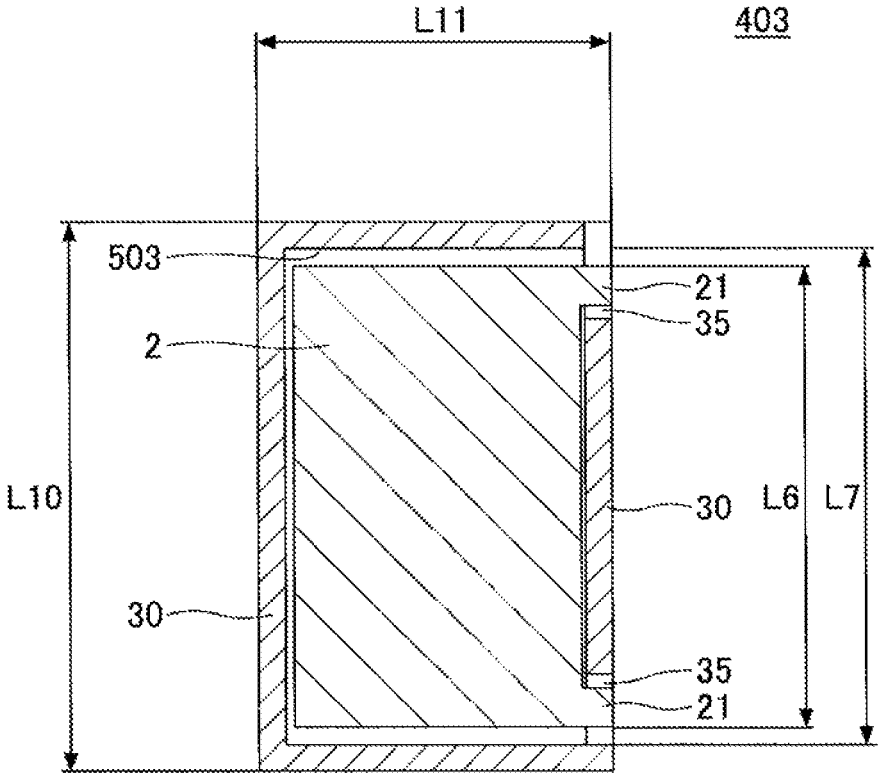
FIG. 11 is a cross-sectional view of the connector unit of FIG. 10 taken along the M-M line.
Figure 12:
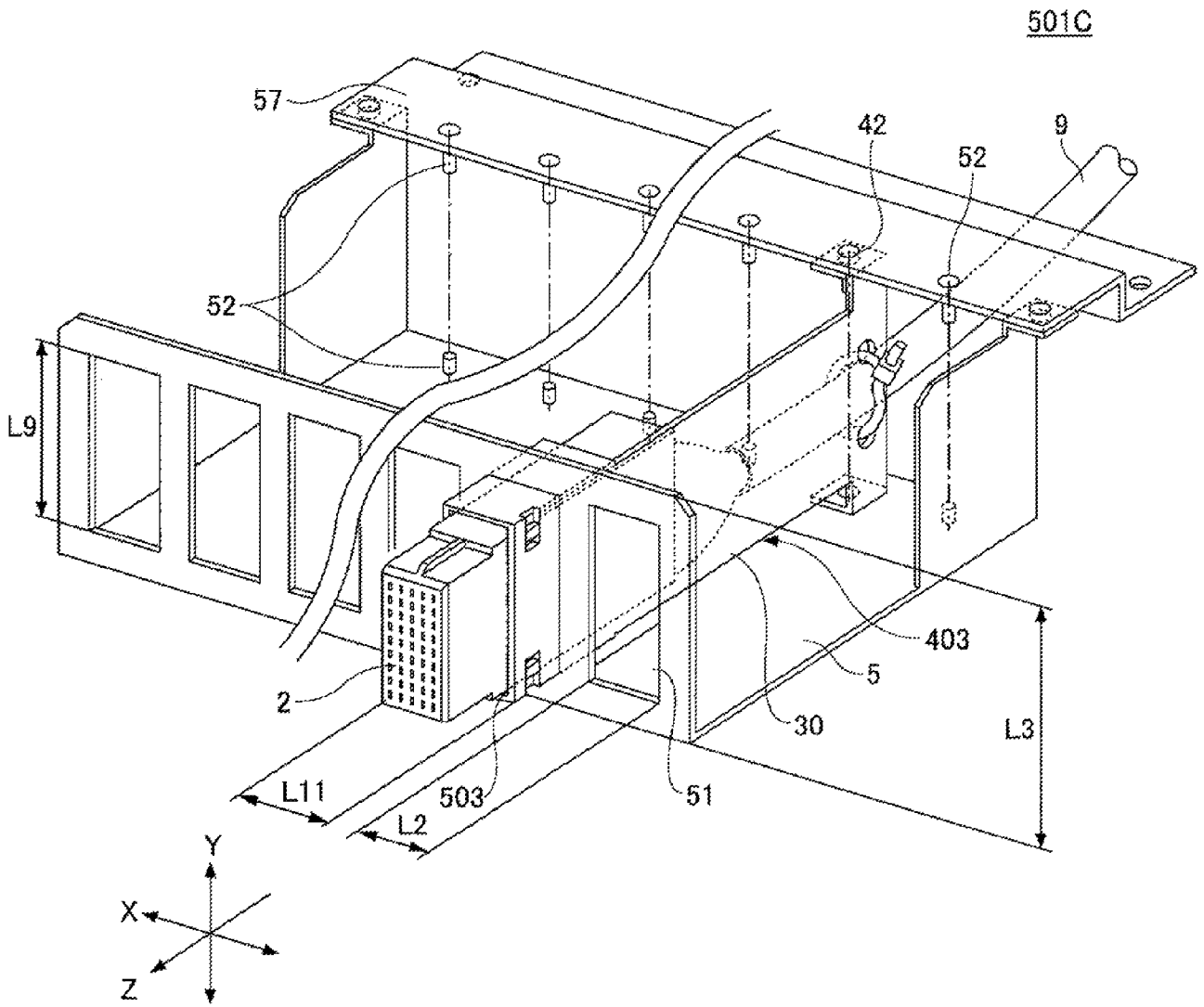
FIG. 12 is a schematic diagram illustrating an intermediate block according to the third embodiment.

FIGS. 10-12 are diagrams for explaining a collective connectors housing and a collective connectors set according to the third embodiment. FIG. 10 schematically illustrates a connector unit 403 of the third embodiment, FIG. 11 is a cross-sectional view of the connector unit 403 taken along the M-M line of FIG. 10, and FIG. 12 illustrates an intermediate block in which multiple connector units 403 are incorporated (although only one connector unit 403 is depicted for the illustration purpose). In the third embodiment, a connector housing 30 of each connector unit 403 allows motion in the Y-direction of the movable connector 2.

In FIG. 10, the connector unit 403 includes a movable connector 2 and the connector housing 30 to hold the movable connector 2. The connector housing 30 has a connector insertion opening 503 to receive the movable connector 2. Holes 35 are formed in the connector housing 30 to receive projections 21 of the movable connector 2. The connector housing 30 also has holes 42 at the trailing end in the insertion direction (Z-direction) to receive pins 52 (see FIG. 6) of the intermediate holder 5 illustrated in the first embodiment. To provide freedom in the Y-direction of the movable connector 2 using the connector housing 30, the Y-direction size of the connector housing 30 is set so as to satisfy a predetermined relationship.

In FIG. 11, assuming that the Y-direction size of the movable connector 2 is L6 and that the Y-direction inner size of the connector housing 30 is L7, then L6 and L7 satisfy the relationship expressed by mathematical formula (5).

$$(L7-L6)/2<(ULy) \quad (5)$$

With this arrangement, the movable connector 2 is movable in the Y-direction within the tolerance ULy.

FIG. 12 is a schematic diagram of an intermediate block 501C in which the connector units 403 are held in the intermediate holder 5 illustrated in FIG. 6. The relationship between the X-direction size L11 of the connector unit 403 and the X-direction size L2 of the rectangular opening 51 of the intermediate holder 5 satisfies mathematical formula (6).

$$(L2-L11)/2<(ULx) \quad (6)$$

Each of the movable connectors 2 is movable in the X-direction independently from the motion in the Y-direction allowed in the connector housing 30. In the third embodiment, the X-direction freedom and the Y-direction freedom are given to each of the movable connectors 2 on the connector basis. In this embodiment, the Y-direction size L9 of the rectangular opening 51 of the intermediate holder 5 is any suitable size unless smooth insertion of the connector unit 403 is prevented. For example, L9 is set almost equal to or slightly greater than the Y-direction size L10 of the connector unit 403 (see FIG. 11).

In the third embodiment, the connector housing 30 used in the connector unit 403 is the first housing that allows the movable connector 2 to move in the Y-direction (i.e., the first direction). The intermediate holder 5 having rectangular openings 51 is the second housing that allows the movable connector 2 to move in the X-direction (i.e., the second direction). The first housing and the second housing form a collective connectors housing.

Since the collective connectors housing is comprised of the connector housing 30 and the intermediate holder 5, the intermediate block 501C with a number of movable connectors 2 assembled into the collective connectors housing becomes a collective connectors set. By plugging the intermediate block 501C in the array of fixed connectors (FIG. 2), the movable connectors 2 can be connected collectively to the fixed connectors 1 at once.

Multiple intermediate blocks 501C may be assembled into a large-scale collective connectors set. For example, the intermediate blocks 501C may be assembled into the rectangular openings 61 of the collective holder 6 illustrated in FIG. 7. In this case, the rectangular opening 61 of the collective holder 6 may not have a Y-direction backlash allowance because X-direction freedom and Y-direction freedom of the movable connector 2 are already provided independently from each other (namely, X-direction freedom in the rectangular opening 51 of the intermediate holder 5 and the Y-direction freedom in the connector housing 30). Accordingly, the Y-direction size L3 of the intermediate holder 5 and the Y-direction size L4 of the rectangular opening 61 of the collective holder (FIG. 7) are suitably selected as long as the intermediate block 501C (i.e., the collective connectors set 501C in this embodiment) is guided smoothly in the rectangular opening 61 such that the movable connectors 2 face the counterpart fixed connectors 1.

By attaching the collective holder in which many of the intermediate blocks 501C of the third embodiment are assembled to the test apparatus 90 of FIG. 2, collective connection and disconnection can be carried out without trouble, as in the first and second embodiments.

[d] Fourth Embodiment

Figure 13:
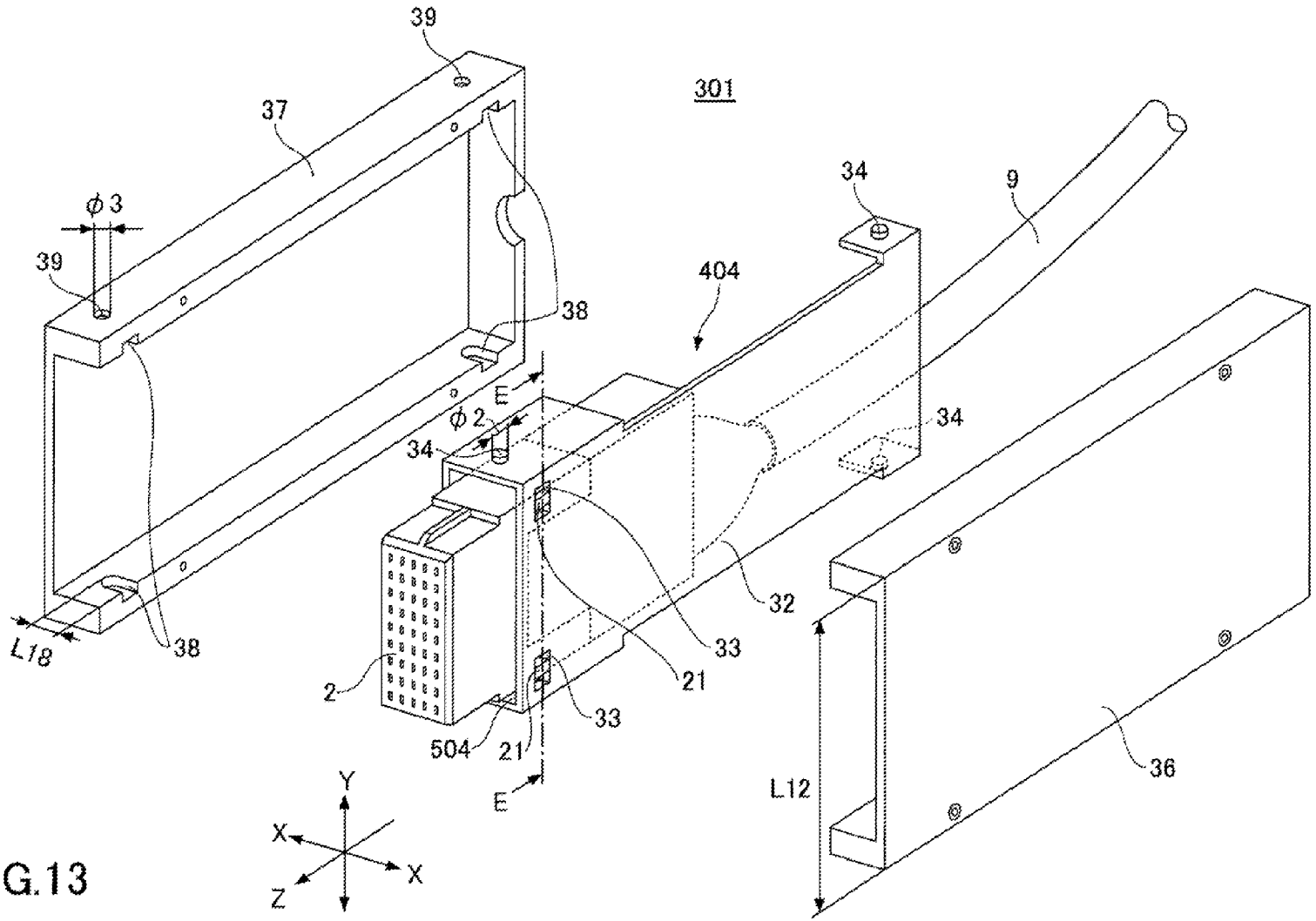
FIG. 13 is an exploded perspective view of a connector block according to the fourth embodiment.
Figure 14:
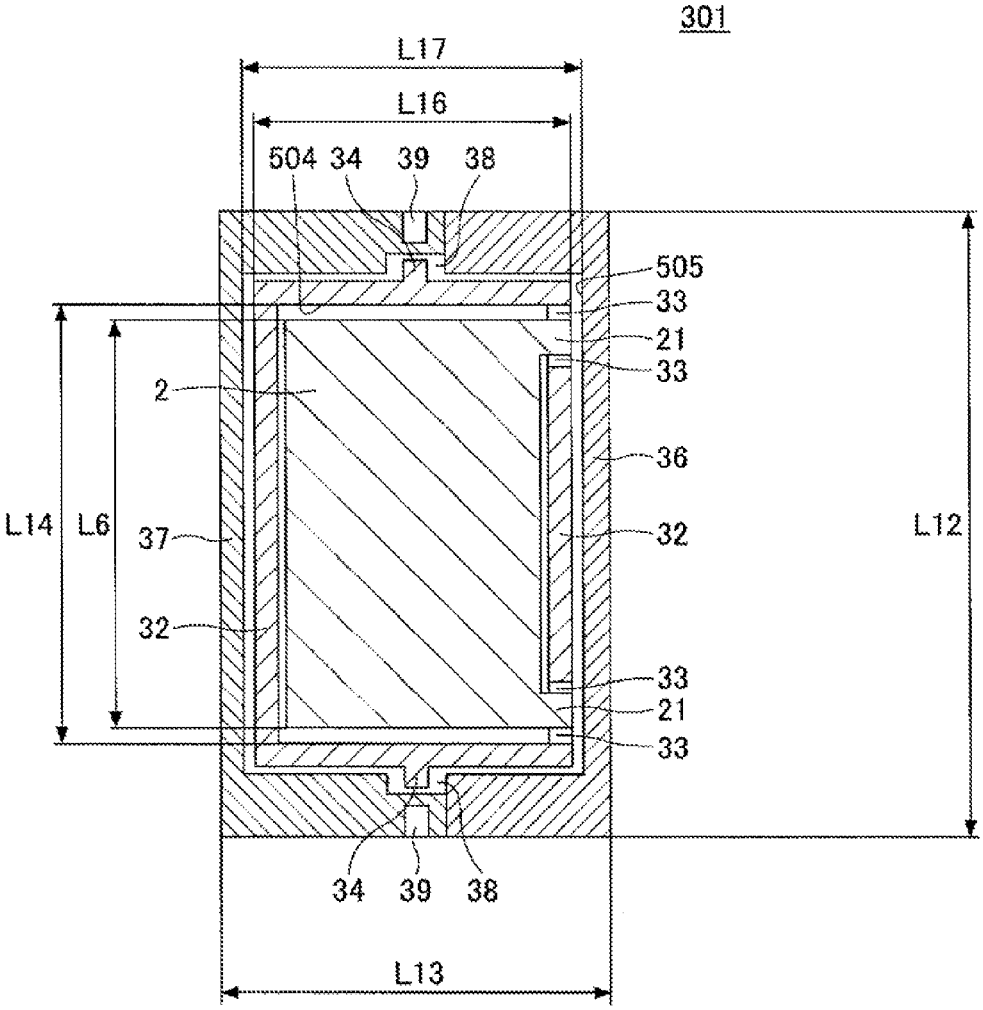
FIG. 14 is a cross-sectional view of the connector block of FIG. 13 taken along the E-E line.
Figure 15:
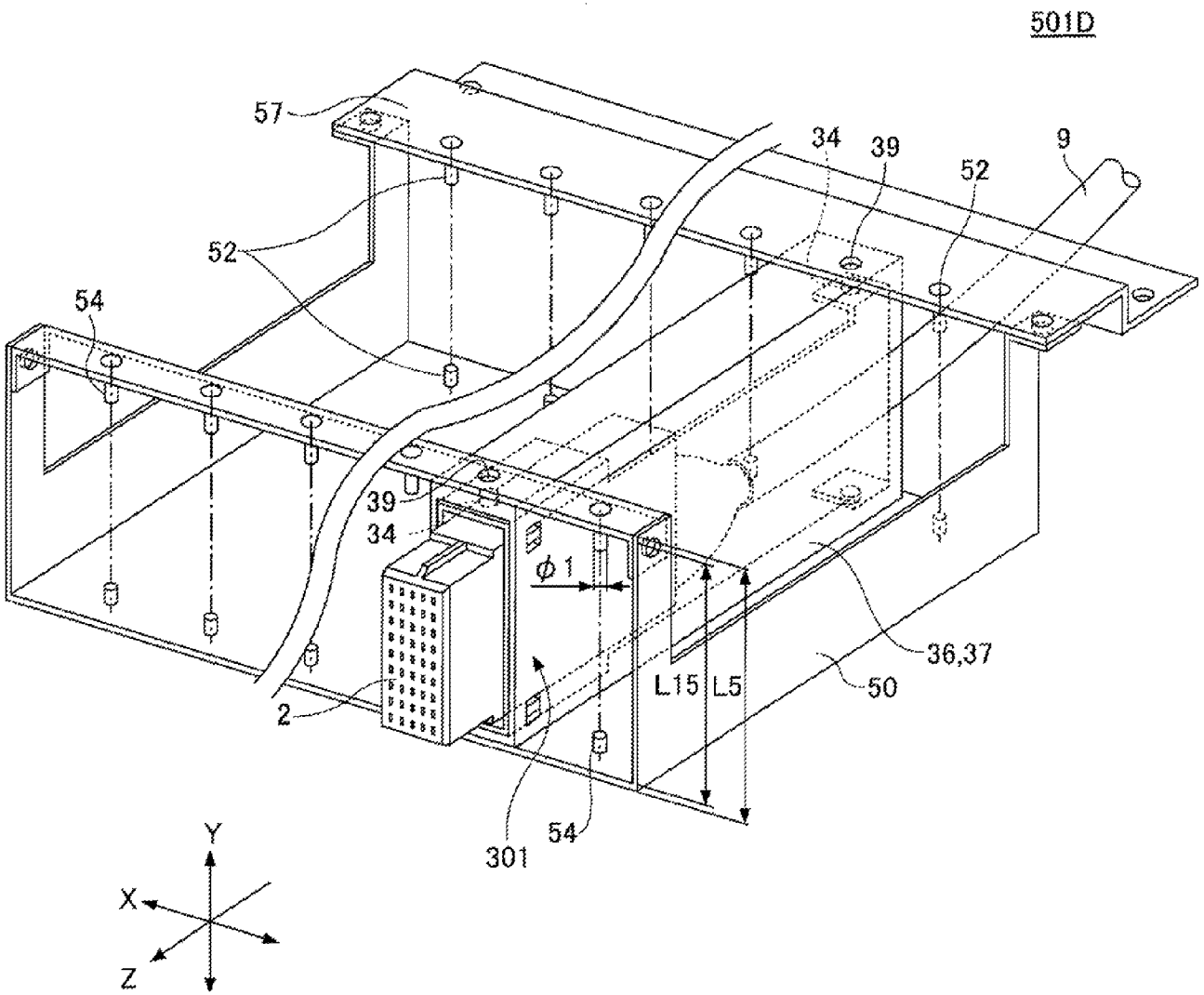
FIG. 15 is a schematic diagram illustrating the connector block and an intermediate block according to the fourth embodiment.

FIG. 13 through FIG. 15 are diagrams for explaining a collective connectors set and a collective connectors housing according to the fourth embodiment. FIG. 13 is an exploded perspective view of a connector block 301 used in the fourth embodiment, FIG. 4 is a cross-sectional view of the connector block 301 taken along the E-E line of FIG. 13, and FIG. 15 is a schematic diagram of an intermediate block 501D which serves as a collective connectors set.

In the fourth embodiment, freedom in motion of the movable connector 2 is given to the X-direction and the Y-direction independently and within a predetermined tolerance by the connector block 301.

In FIG. 13, a connector unit 404 includes a movable connector 2 and a connector housing 32. The movable connector 2 is held in a connector insertion opening 504 of the connector housing 32 such that the leading end projects from the connector housing 32. Projections 21 of the movable connector 2 are received in holes 33 of the connector housing 32. The holes 33 are elongated holes extending in the Y-direction and the projections 21 can move in the Y-direction. Accordingly, the movable connector 2 is held in the connector housing 32 so as to be movable in the Y-direction. direction. The connector housing 32 has pins 34 at the leading end and the trailing end along the insertion direction (Z-direction). The connector unit 404 is held between the connector holders 36 and 37. The connector holder 37 has connector grooves 38 extending in the X-direction to receive the pins 34 of the connector housing 32. The connector holder 37 also has holes 39 to receive pins 54 of an intermediate holder 50, which will be described below.

The diameter Φ2 of the pin 34 of the connector housing 32 and the X-direction size L18 of the connector groove 38 of the connector holder 37 satisfy the relationship expressed by formula (7).

$$(L18-\Phi 2)/2<(ULx) \quad (7)$$

The movable connector 2 is allowed to move in the connector block 301 within the range of tolerance.

In FIG. 14, the movable connector 2 is held in the connector insertion opening 504 of the connector housing 32. The Y-direction inner size L14 of the connector housing 32 and the Y-direction size L6 of the movable connector 2 satisfy the relationship expressed by formula (8).

$$(L14-L6)/2<(ULy) \quad (8)$$

The connector unit 404 of FIG. 13 is held in a housing insertion opening 505 defined after the connector holders 36 and 37 are combined. The Y-direction size of the housing insertion opening 505 is selected so as not to disturb the motion of the connector housing 32 in the connector holders 36 and 37.

In the fourth embodiment, the connector housing 32 that holds the movable connector 2 so as to be movable in the Y-direction becomes the first housing. The connector holders 36 and 37 that hold the connector unit 404 so as to be movable along the connector grooves 38 in the X-direction becomes the second housing. By assembling the connector blocks 301 in the intermediate holder 50 illustrated in FIG. 8, the intermediate block 501D which serves as a collective connectors set is acquired.

FIG. 15 schematically illustrates the intermediate block 501D. The pins 52 and 54 are fit into the holes 39 of the connector holder 37, whereby the connector blocks 301 are fixed to the intermediate holder 50 (although only one connector block 301 is depicted for the illustration purpose). Because freedom of motion of the movable connector 2 is already provided in the X-direction and the Y-direction independently from each other in the connector block 301, additional backlash allowance for the intermediate holder 50 need not be provided when assembling the connector blocks 301 in the intermediate holder 50.

The intermediate block 501D serves as a collective connectors set which is capable of collective connection and disconnection of the movable connectors 2 to and from the fixed connectors 1, while allowing each of the movable connectors 2 to move in the X-direction and the Y-direction independently.

The collective connectors set may be modified using a collective holder 6 illustrated in FIG. 7, but with different dimensions and arrangement of openings 61. To assemble plural of the connector blocks 301 illustrated in FIG. 13 and FIG. 14 in the collective holder 6, in place of the intermediate holder 50 of FIG. 8, the rectangular opening 61 of the collective holder 6 is designed to allow smooth motion of the connector block 301 in the connector insertion direction. For example, the dimensions L4 and L41 of the rectangular opening 61 are selected so as to provide a slight clearance gap with respect to L12 and L13 of the connector block 301, respectively. The rectangular opening 61 of the collective holder 6 has the guide faces 62 and 63 (see FIG. 7) to smoothly guide the connector block 301.

By attaching the modified collective connectors set to the test apparatus 90 of FIG. 2, a number of movable connectors 2 can be connected to and disconnected from the array of fixed connectors 1 at a time. The connector block 301 is free from the risk of oblique insertion with respect to the connector insertion axis owing to the guide faces 62 and 63. This arrangement is advantageous from the viewpoint of work efficiency and work quality especially when the functional test is repeated many times.

[e] Fifth Embodiment

Figure 16:
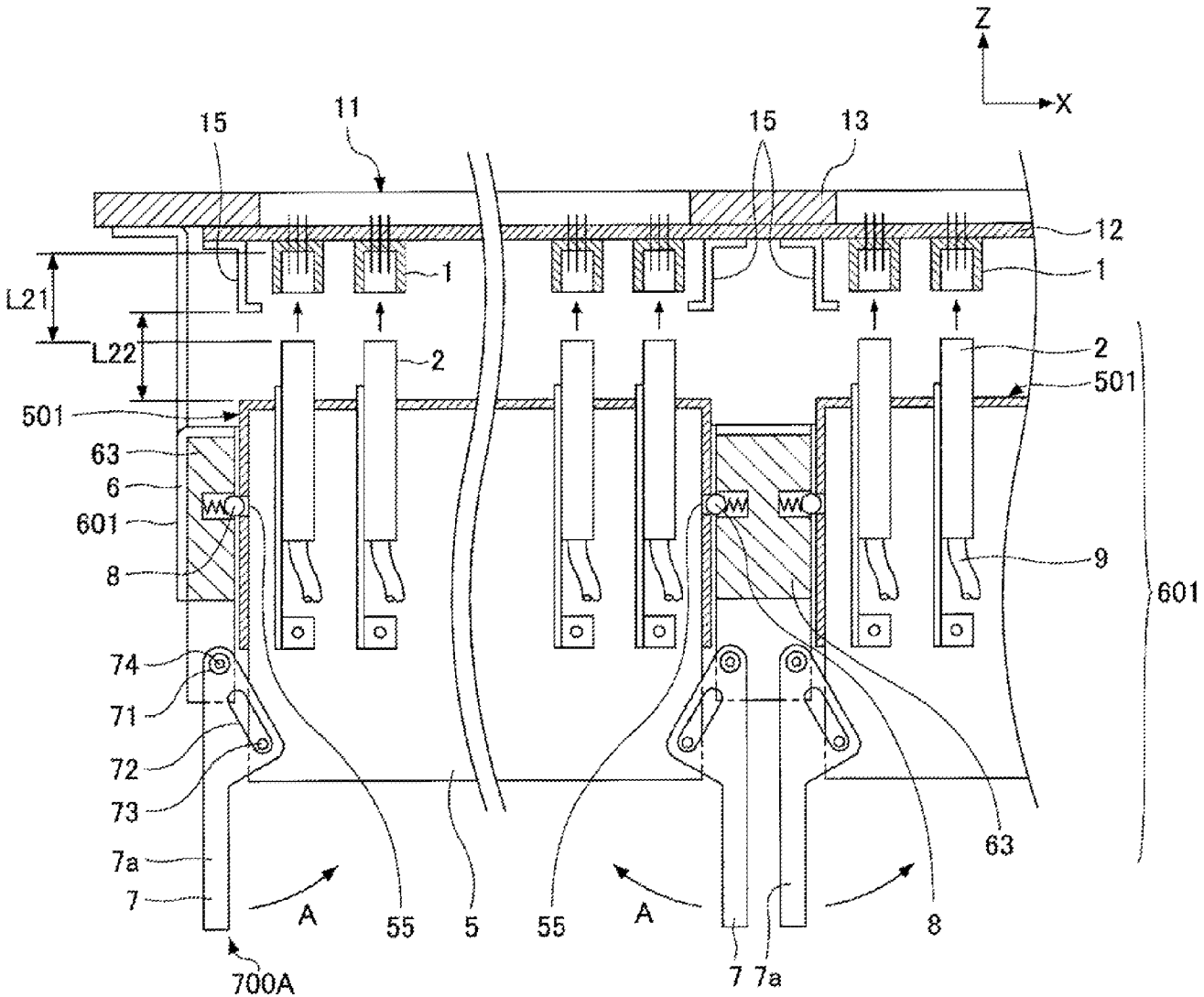
FIG. 16 is a schematic diagram illustrating a secure mechanism according to the fifth embodiment.

FIG. 16 is a schematic diagram of a collective connectors set 601 with a securing mechanism according to the fifth embodiment. The securing mechanism prevents excessive load on the movable connectors 2 and the fixed connectors 1 during collective connection and disconnection to avoid breakage due to the excessive load. This arrangement can assure reliable connection.

As the first example of the securing mechanism, the collective connectors set 601 has a load reduction mechanism 700A. In FIG. 16, a semifinished product 11 is set in a test apparatus 90 for a functional test. The movable connectors 2 of an intermediate block 501 held in a collective holder 6 are brought into connection with the corresponding fixed connectors 1 on a printed circuit board 12 collectively in a cross-sectional horizontal plane along the insertion direction.

The load reduction mechanism 700A prevents the intermediate blocks 501A, 501B, 501C or 501D of the first through fourth embodiments (referred to simply as "intermediate block 501") from falling from the collective holder 6. Besides, the load reduction mechanism 700A reduces the load on the connectors when multiple removable connectors 2 are collectively connected to and disconnected from the fixed connectors 1 on the block-by-block basis.

The load reduction mechanism 700A includes a lever 7. The lever 7 has a handle 7*a*, a rotational hole 71 which can rotate around a pin 74 of the collective holder 6, and an elongated hole 72 which can slide with respect to the pin 73 of an intermediate holder 5 (or the intermediate holder 50).

Two of the levers 7 are provided symmetrically one on each side of the intermediate block 501. When the movable connectors 1 are the farthest away from the fixed connectors 1 within a connection/disconnection range, the handles 7*a* of the levers 7 point in the trailing end direction along the insertion axis (Z-axis), in other words, the direction of disconnection. When the levers 7 are rotated inward in the directions A, the movable connectors 2 advance toward the fixed connectors 1. The rotational hole 71 and the elongated hole 72 of the lever 7 are designed such that the movable connectors 2 are connected collectively to the counterpart fixed connectors 1 when the handles 7*a* of the levers 7 become perpendicular to the Z-axis. The rotational hole 71 and the elongated hole 72 may be arranged in reverse.

By attaching the collective connectors set (i.e., the collective block) 601 with the lever structure to the test apparatus 90 of FIG. 2, collective connection and disconnection of the movable connectors 2 to and from the fixed connectors 1 can be carried out efficiently on the block-by-block basis without trouble. In addition, when the collective connectors set 601 provided to the test apparatus 90 is opened or closed as illustrated in FIG. 2, the intermediate blocks 501 (any type of intermediate blocks 501A through 501D) can be prevented from falling from the collective holder 6. Because the intermediate block 501 is held in the collective block 601, it is unnecessary to handle individual removable connectors 2. Consequently, the efficiency of the functional test is advantageously improved.

Because the handles 7*a* of the levers 7 are arranged so as not to open outwardly in the X-direction, the intermediate blocks 501 can be arranged densely at narrow intervals in the X-direction.

Figure 17:
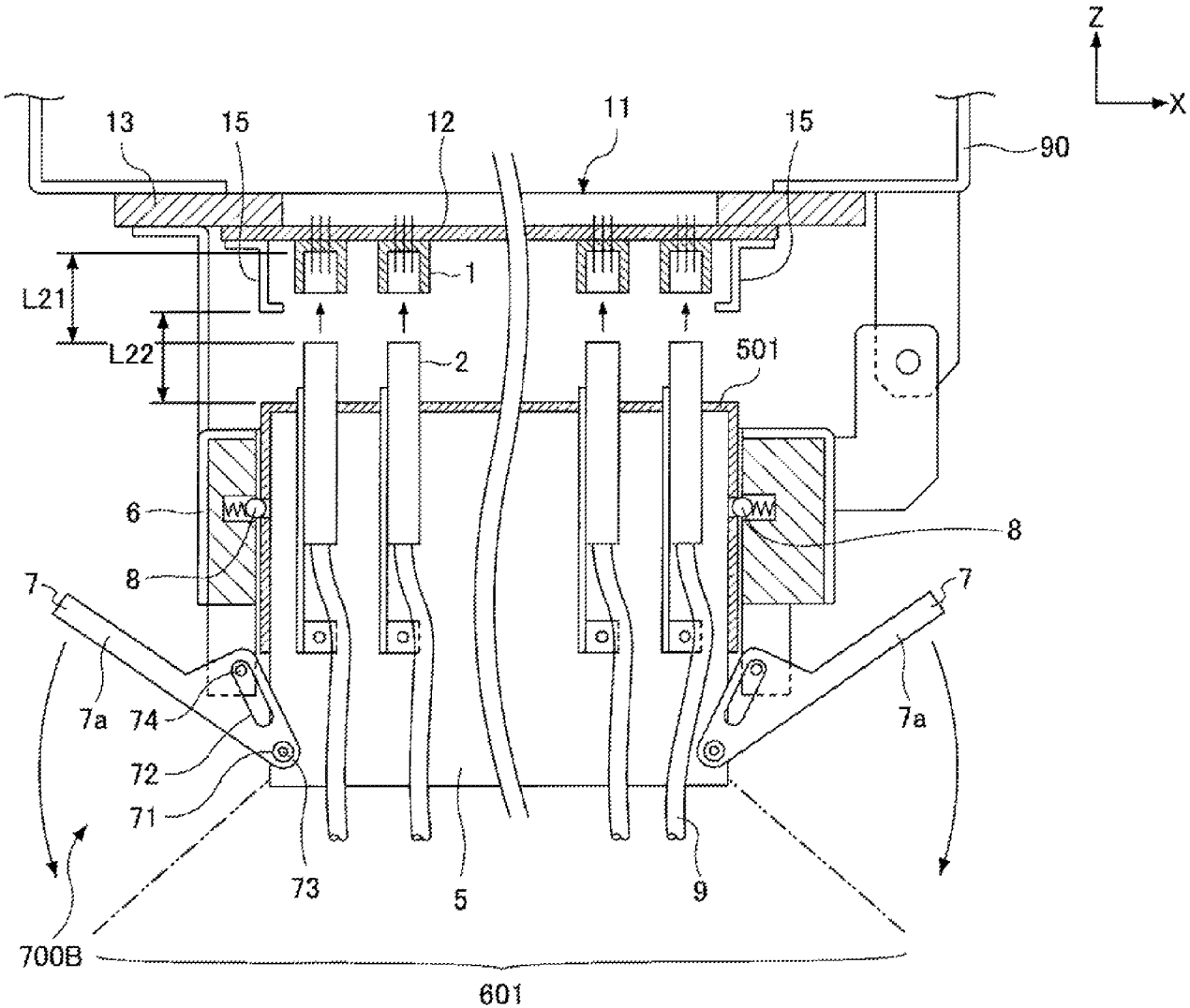
FIG. 17 illustrates a modification of the secure mechanism of FIG. 16.

FIG. 17 illustrates a modification 700B of the load reduction mechanism of FIG. 16. The lever 7 of the load reduction mechanism 700B has a rotational hole 71 rotatable around a pin 73 of the intermediate holder 5 (or the intermediate holder 50) and an elongated hole 74 sliding along the pin 74 of the collective holder 6. Two of levers 7 are provided symmetrically one on each side of the intermediate block 51, as in FIG. 16, but with different orientations.

In FIG. 17, when the movable connectors 2 are the farthest away from the fixed connectors 1 within the connection/disconnection range, the handles 7*a* of the levers 7 are open outward from the intermediate block 501 and point closer to the fixed connectors 1. For connector connection, the handles 7*a* of the levers 7 are rotated so as to move away from the fixed connectors 1 in the directions of the curved arrows in the figure. Then the movable connectors 2 advance toward the fixed connectors 1. The rotational hole 71 and the elongated hole 72 of the lever 7 are designed such that the movable connectors 2 are brought into connection with the fixed connectors 1 within a range where the handles 7*a* of the levers 7 pass through the position perpendicular to the Z-axis and are further rotated up to 45 degrees from the perpendicular position. The rotational hole 71 and the elongated hole 72 may be arranged in reverse.

By attaching the collective connectors set (i.e., the collective block) 601 with the modified load reduction mechanism to the test apparatus 90 of FIG. 2, connection and disconnection of the movable connectors 2 to and from the fixed connectors 1 can be carried out efficiently on the block-by-block basis without trouble. In addition, when the collective connectors set 601 provided to the test apparatus 90 is opened or closed as illustrated in FIG. 2, the intermediate blocks 501 (including intermediate blocks 501A through 501D) can be prevented from falling from the collective holder 6. Because the intermediate block 501 is held in the collective block 601, it is unnecessary to handle individual removable connectors 2. Consequently, the efficiency of the functional test is advantageously improved.

Because the handles 7*a* of the levers 7 do not enter the cable connection side of the intermediate block 501, the freedom of arrangement of cables 9 is improved.

As the second example of the securing mechanism, a temporary stopper mechanism is provided to the collective connectors set (collective block) 601. The temporary stopper mechanism temporarily stops insertion of any type of the intermediate blocks 501A-501D of the first through fourth embodiments (referred to simply as "intermediate blocks 501") at a certain position in the Z-direction along the guide faces 62 and 63 (see FIG. 7) of the collective holder 6.

The temporary stopper mechanism includes a ball 8 with a spring illustrated in FIG. 16. The ball 8 with the spring is engaged with a hole 55 of the intermediate holder 5 (or the intermediate hole 50) to temporarily stop the motion of the intermediate block 501 in the Z-direction. The spring force of the ball 8 is adjusted such that the ball 8 comes out of the hole 55 when the levers 7 are rotated to bring the movable connectors 2 into connection with the fixed connectors 1. The position for temporarily stopping the insertion of the intermediate block 501 is determined such that the movable connectors 2 of the intermediate block 501 are located the farthest away from the fixed connectors 1 within the connection/disconnection range. The ball 8 with a spring may be provided to one side or both sides of the X-direction guide face 63, or alternatively, it may be provided to one side or both sides of the Y-direction guide face 62. The ball 8 with a spring may be replaced by a projection with a leaf spring, which projection is engaged with the hole 55 at the temporary stop position.

The temporary stopper mechanism may also be applied to the modification illustrated in FIG. 17. By providing the temporary stopper mechanism, undesirable collision between the movable connectors 2 and the fixed connectors 1 can be avoided even if the movable connectors 2 are unintentionally pushed toward the fixed connectors 1 during the process of closing the collective block 601 of the test apparatus 90 to bring the movable connectors 2 to face the fixed connectors 1.

As the third example of the securing mechanism, a breakage prevention mechanism is provided to the collective connectors set (i.e., the collective block) 601. The breakage prevention mechanism has a function to protect the movable connectors 2 of the first through fourth embodiments from breakage due to an excessive force applied thereon during collective connection and disconnection to and from the fixed connectors. The breakage prevention mechanism includes, for example, a stopper 15 illustrated in FIG. 16 and FIG. 17.

In FIG. 16, the collective block 601 is positioned with respect to the test object (semifinished product) 11 such that the movable connectors 2 of the intermediate block 501 are the farthest away from the fixed connectors 1 within the connection/disconnection range. The distance between the connecting face of the movable connector 2 in the intermediate block 501 and the final connection face of the fixed connector 1 is L21, and the distance between the stopper 15 and the leading end (facing the fixed connector 1) of the intermediate holder (or the intermediate holder 50) is L22. The stopper 15 is provided to the test object (semifinished product) 11 or the test apparatus 90 such that L22 is close to L21 but greater than L21. The same arrangement can be applied to the structure of FIG. 17.

This arrangement can prevent an excessive stress from being applied to the fixed connectors 1 and the movable connectors 2 even if a large connection force is produced using the levers 7. Consequently, breakage of the fixed connectors 1 and the movable connectors 2 can be avoided advantageously.

[f] Sixth Embodiment

Figure 18:
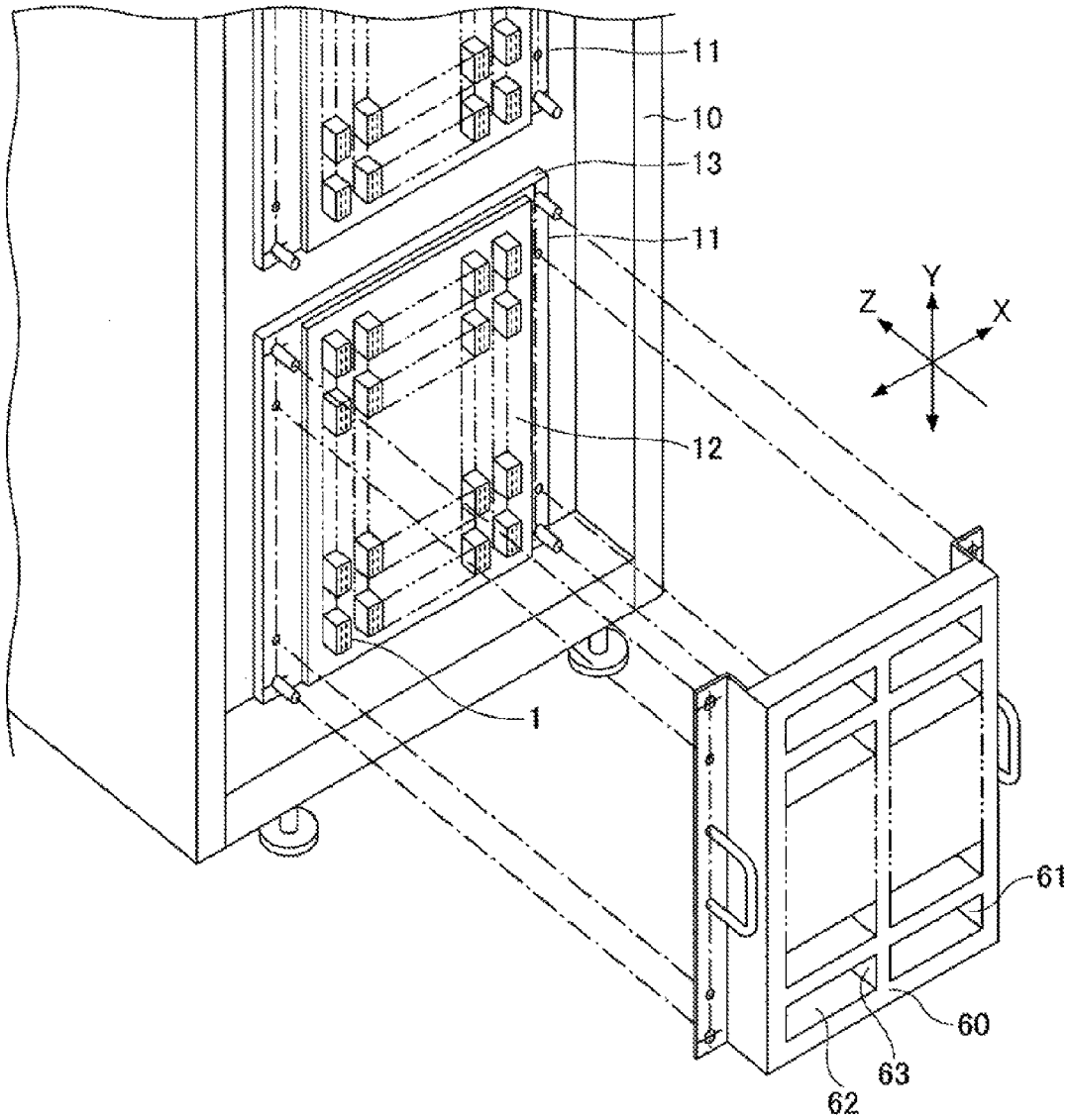
FIG. 18 illustrates an example of installation of the collective holder into an electronic apparatus.

FIG. 18 is a schematic diagram of a computer 10 as an example of an electronic apparatus according to the sixth embodiment. In this embodiment, a semifinished product 11, which is an example of a test object, is maintained in the computer 10 during a functional test under collective connection of connectors. The semifinished product 11 includes a number of fixed connectors 1 mounted on a printed circuit board 12, and held on a reinforcing board 13.

A collective holder 60 is placed to cover the semifinished product 11 and fixed to the computer 10. The collective holder 60 has multiple rectangular openings 61. The inner walls 62 extending in the X-direction and the inner walls 63 extending in the Y-direction of the rectangular opening 61 serve as guide walls for guiding any type of intermediate blocks 501A through 501D that hold multiple movable connectors 2. For the functional test, intermediate blocks 501 which serve as collective connectors sets are successively inserted in the rectangular openings 61. The guide walls 62 and 63 guide the intermediate block 501 toward the fixed connectors 1 such that the insertion axis of the movable connect 2 is coincident with the receiving axis of the corresponding fixed connector 1.

With this embodiment, the test object or the semifinished product 11 need not be removed from the computer 10 and set in a test apparatus, unlike the structure illustrated in FIG. 2. Functional tests and collective connection and disconnection of a large number of connectors are available even after the computer 10 is set up, and freedom of applications increases.

With the above-described embodiments, a number of connectors can be connected and disconnected collectively at a time, and the work efficiency is improved. Because no relay component such as a relay board is used for connection, transmission loss can be reduced. The collective connection structure of the embodiments is applicable to a narrow space with connectors arranged at small intervals.

The movable connector is held movable in the first direction (e.g., the X-direction) and the second direction (e.g., the Y-direction) orthogonal to the first direction independently from each other within a plane perpendicular to the connector insertion direction. Accordingly, undesirable rotation or skew of the movable connector is prevented. A set of movable connectors aligned in the X-direction or the Y-direction can be connected collectively to a set of fixed connectors at a time.

The movable connectors can be arranged densely, while allowing the individual connectors to move within tolerances. Accordingly, the structures of the embodiments are applicable to a high-density connector array with fixed connectors arranged at narrow intervals.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the embodiments of the present inventions have been described in detail, it should be understood that the various changes, substitutions, and alterations could be made hereto without departing from the spirit and scope of the invention.

What is claimed is:

1. A collective connectors housing comprising:

a first housing having a connector insertion opening to receive one or more connectors and configured to hold said one or more connectors in the connector insertion opening so as to be movable in a first direction perpendicular to a connector insertion direction; and a second housing having a housing insertion opening to receive the first housing and configured to hold the first housing so as to be movable in a second direction perpendicular to both the connector insertion direction and the first direction.

2. The collective connectors housing according to claim 1, wherein the connector insertion opening of the first housing is configured to hold an individual of said one or more connectors to allow the individual connector to move in the first direction, and wherein the housing insertion opening of the second housing is configured to hold one or more blocks of said connectors held in the first housing such that said one or more blocks of said connectors are movable in the second direction on a block-by-block basis.

3. The collective connectors housing according to claim 1, wherein the first housing has plural of the connector insertion openings, each of the connector insertion openings being configured to receive one of the connectors, and wherein the second housing has one or more of the housing insertion openings, each of the housing insertion openings being configured to hold the first housing so as to be movable in the second direction independently from motion of said connector in the first direction in the first housing.

4. The collective connectors housing according to claim 1, wherein the first housing has a pin configured to be fit into an elongated hole provided to a connector unit that includes a corresponding one of said one or more connectors, the pin being movable relative to the elongated hole extending in the first direction and allowing said one or more connectors to move in the connector insertion opening in the first direction, and wherein the second housing has one or more of the housing insertion openings, each of the housing insertion openings being configured to hold the first housing so as to be movable in the second direction independently from the motion of said one or more connectors in the first direction.

5. The collective connectors housing according to claim 1, wherein the connector insertion opening of the first housing is configured to hold an individual of said one or more connectors to allow the individual connector to move in the first direction, and wherein the housing insertion opening of the second housing is configured to hold the individual of said one or more connectors to allow the individual connector to move in the second direction.

6. The collective connectors housing according to claim 1, wherein the first housing has a elongated hole extending in the first direction and receiving a projection provided on each of said one or more connectors, and wherein the second housing has plural of the housing insertion openings to receive plural of said first housings and allow the first housings to move in the second direction independently from each other.

7. The collective connectors housing according to claim 1, wherein the first housing has an elongated hole extending in the first direction for receiving a pin formed in said one or more connectors, and anther pin to be received in the second housing; and wherein the second housing has a connector groove extending in the second direction for receiving the other pin of the first housing.

8. The collective connectors housing according to claim 1, wherein if a length in the first direction of said one or more connectors is L1, if a length in the first direction of the connector insertion opening is L2, and if a positioning tolerance in the first direction allowed for said one or more connectors is ULx, then L1, L2 and ULx satisfy a relationship $$(L2-L1)/2<ULx.$$

9. The collective connectors housing according to claim 1, wherein if a length in the second direction of the first housing is L3, if a length in the second direction of the housing insertion opening is L4, and if a positioning tolerance in the second direction allowed for said one or more connectors is ULy, then L3, L4 and ULy satisfy a relationship $$(L4-L3)/2<ULy.$$

10. A collective connectors set comprising:

a plurality of connectors;

a first housing having one or more connector insertion openings for holding the connectors so as to be movable in a first direction perpendicular to a connector insertion direction; and a second housing having a housing insertion opening for holding the first housing so as to be movable in a second direction perpendicular to the first direction and the connector insertion direction.

11. The collective connectors set according to claim 10, further comprising:

a lever configured to push the connectors toward a position of connection with counterpart connectors and retract the connectors from the position of connection with the counterpart connectors.

12. The collective connectors set according to claim 10, further comprising:

a temporary stopper mechanism configured to temporarily stop the motion of the connectors toward the position of connection at a predetermined position.

13. An electronic apparatus comprising:

a plurality of first connectors arranged on a board; and a collective connectors set including a plurality of second connectors to be connected to the first connectors connectors;

wherein the collective connectors set further includes:

a first housing having one or more connector insertion openings for holding the second connectors so as to be movable in a first direction perpendicular to a connector insertion direction; and a second housing having a housing insertion opening for holding the first housing so as to be movable in a second direction perpendicular to the first direction and the connector insertion direction.

14. The electronic apparatus according to claim 13, further comprising:

a rotational shaft configured to support the collective connectors set so as to be openable and closable with respect to the board.

15. The electronic apparatus according to claim 13, further comprising:

a stopper provided on the board and to receive the collective connectors set.

* * * * *